US006377657B1

(12) United States Patent
Scholz

(10) Patent No.: US 6,377,657 B1
(45) Date of Patent: Apr. 23, 2002

(54) METHOD AND LOAD CALCULATOR TO CALCULATE THE TEMPERATURE DISTRIBUTION OF AN ANODE OF AN X-RAY TUBE

(75) Inventor: Bernhard Scholz, Heroldsbach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/646,131

(22) PCT Filed: Mar. 12, 1999

(86) PCT No.: PCT/DE99/00695

§ 371 Date: Nov. 7, 2000

§ 102(e) Date: Nov. 7, 2000

(87) PCT Pub. No.: WO99/48342

PCT Pub. Date: Sep. 23, 1999

(30) Foreign Application Priority Data

Mar. 13, 1998 (DE) ..... 198 11 041

(51) Int. Cl.[7] ..... H05G 1/36
(52) U.S. Cl. ..... 378/118; 378/117
(58) Field of Search ..... 378/114, 117, 378/118, 207

(56) References Cited

U.S. PATENT DOCUMENTS 5,809,106 A * 9/1998 Kitade et al. ..... 378/132
6,088,425 A * 7/2000 Ono ..... 378/117
6,125,167 A * 9/2000 Morgan ..... 378/124

FOREIGN PATENT DOCUMENTS

| | | |
|---|---|---|
| DE | AS 23 45 947 | 2/1981 |
| DE | OS 36 06 587 | 9/1987 |
| DE | OS 41 34 126 | 4/1993 |
| EP | 0 793 404 | 9/1997 |
| FR | 2 292 399 | 6/1986 |
| GB | 1 498 824 | 1/1978 |

* cited by examiner

*Primary Examiner*—David P. Porta
(74) *Attorney, Agent, or Firm*—Schiff Hardin & Waite

(57) ABSTRACT

In a method and a load computer for calculating the space-time temperature distribution in or, on an anode bombarded with electrons in an x-ray tube. The brief-term temperature boost in a surface layer in and around a focus spot on the anode of the x-ray tube is thereby calculated for the time span during and immediately after the electron bombardment of the focal spot, being calculated by the load computer. The load computer then calculates the long-term temperature distribution in the entire volume of the anode, taking into consideration the heat propagation that emanates from the focal spot as well as the heat emission from the surface of the anode. The results of the two calculations are added for determining the temperature distribution on and in the anode and, are displayed at a display and/or are, employed for driving the x-ray tube.

13 Claims, 26 Drawing Sheets

METHOD AND LOAD CALCULATOR TO CALCULATE THE TEMPERATURE DISTRIBUTION OF AN ANODE OF AN X-RAY TUBE

BACKGROUND OF THE INVENTION

1. Field of the Invention

The present invention is directed to a method for calculating the space-time temperature distribution in and on an electron-irradiated anode of an X-ray tube for determining the load of the X-ray tube in a load computer for calculating use in the temperature distribution of an anode of an X-ray tube and is also directed to an X-ray apparatus having such a load computer for performing such a method.

2. Description of the Prior Art

As known, is the generation of X-rays ensues by irradiating an anode with electrons proceeding from a cathode. There is the known problem that only one percent of the electron beam energy is converted into the desired X-radiation, even given an anode surface of tungsten (high atomic number Z, Z=74). A large part of the electron beam energy merely heats the anode material. In the case of an X-ray tube, the remaining beam energy is scattered back into the inside of the housing of the X-ray radiator. The electron irradiation of the anode must therefore be interrupted when temperatures that reach or, respective, exceed the respective, maximally permitted operating temperature are reached in the anode block composed of various materials. On the other hand, the system is not optimally utilized if a premature shutoff of the X-ray apparatus occurs.

This problem is in fact usually alleviated—but not eliminated—by anodes rotating at high speed.

The temperature distribution of the anode must thus be acquired for protecting the X-ray tube. The thermic condition of the anode can thereby be mensurationally or computationally acquired. Since the thermic condition of the anode, particularly the condition at individual anode locations, is extremely difficult or, impossible (at inside anode locations) to identify by means of measurements computational determination methods are utilized. In the computational acquisition of the thermal condition of the anode, a computer permanently determines the respective temperature distribution of the anode, for example from the cumulative loads and the cooling curve, and indicates them, for example, as percentage heat unit (HU) values. The waiting time after an X-ray exposure can be determined from the selected data for the following load and displayed with the assistance of fast micro-computers. Such a computer, called a tube load computer, or load computer can therefore optically and/or acoustically indicate inadmissible conditions for the X-ray apparatus to the operator and/or control the X-ray apparatus according to the calculated temperature distribution.

Load computers hitherto employed are based on simpler physical models. This can lead thereto that the X-ray means is in part prematurely shut off and, thus, an optimum utilization of the X-ray means is prevented.

Further, theoretical calculations of anode temperature distributions are known. Simple one-dimensional and two-dimensional model calculations about the anode surface temperature are known, for example, from G. E. Vibrans, "Calculation of the Surface Temperature of a Solid under Electron Bombardment", MIT Lincoln Laboratory, Technical Report No. 268, 1962, or from S. Whitaker, "X-Ray Anode Surface Temperatures: The Effect of Volume Heating, SPIE Vol. 914, Medical Imaging II, 565, 1988. More involved calculations of the anode temperatures are known, for example, from H. Dietz, E. Geldner, "Temperature Distribution in X-Ray Rotating Anodes", Part 1. Physical Principles, Siemens F & E-Ber., 7, 18, 1978. These known techniques cannot assure that the X-ray tube is optimally utilized due to an exact calculation of the temperature distribution of the anode.

SUMMARY OF THE INVENTION

An object of the present invention is to enable an improved operational use of X-ray systems in that the temperature development and distribution of the anode is computationally determined better than before.

The point of departure of the invention is to determine the space-time temperature distribution in the anode from two different contributions, namely from the short-term temperature boost in and around the focal spot during and immediately after the brief-duration electron bombardment of the focal spot, as well as from the long-term space-time temperature distribution in the overall anode volume as a result of the heat propagation that proceeds from the focal spot and as a result of the heat emission from the anode surface. Accordingly, the mathematical-physical model of the anode is composed of two independent sub-models, namely a short-term load model and a long-term load model.

"Short-term" in the sense of the present specification thereby indicates a time span wherein the electron bombardment of a focal spot ensues. This is usually a time span in the range from approximately 10 through 100 $\mu$s.

"Long-term", in contrast, indicates a time span wherein the overall image data of an X-ray exposure are usually acquired, i.e. usually more than approximately 1 s.

According to the invention, a method is provided for calculating the space-time temperature distribution in an electron-bombarded anode of an X-ray tube. The short-term temperature boost is thereby measured in a surface layer in and around a focal spot on the anode for the time span during and immediately after the electron bombardment of the focal spot, being calculated according to the general thermal conduction equation for uniform heat conductors. Further, the long-term temperature distribution in the overall volume of the anode is calculated taking the heat propagation that proceeds from the focal spot and the heat emission from the surface of the anode into consideration, being calculated according to the general thermal conduction equation for non-uniform heat conductors. The results of the two calculations are then added for determining the temperature distribution on or, respectively, in the anode. The result of the calculation, the load of the X-ray tube, can be displayed for the user and/or taken into consideration in the drive of the X-ray tube. These calculations of the temperatures of the anode make it possible to protect the X-ray anode against destruction due to overheating. The X-ray generator can be deactivated shortly before the upward transgression of permitted maximum temperatures at selected anode locations such as, for example, in the focal ring or in the boundary layer between anode material. Further, the method can be employed to calculate in advance whether an X-ray examination can still be carried out in view of the thermal load on the anode or whether a pause for cooling the anode is required.

One or more of the following factors can be inventively taken into consideration in the calculation of the short-term temperature boost:

The backscatter of the bombarding electrons in the form of a multiplicative factor <1. This factor thus reproduces the reduction in the power supplied to the anode due to the backscatter.

Given movement of the anode during the bombardment, the relative motion of the electron beam with respect to the anode can be taken into consideration in the calculation of the short-term temperature boost by topical variation of a heat source function.

Given non-homogeneous profile of the electron beam, the inhomogeneity of the beam profile can be taken into consideration in the calculation of the short-term temperature boost by discretizing the area of the focal spot into individual area elements.

At least one of the following factors can be inventively taken into consideration in the calculation of the long-term temperature distribution:

the backscatter of the bombarding electrons in the form of a multiplicative factor that is less than 1, whereby this factor can be different (usually greater) than the backscatter factor in the calculation of the short-term temperature boost.

The three-dimensional heat flow by describing the volume of the anode as cylinder, whereby the cylinder is composed of one material layer or is a composite of a plurality of layers of different materials.

The radiation exchange between the surface of the anode and the environment (housing) of the anode, as well as the temperature dependency of the material parameters.

Inventively, a load computer for calculating the temperature distribution of an anode of an X-ray tube is also provided. This load computer is programmed to execute the aforementioned method and has a display for displaying the results of the calculations, and controls the operation of the X-ray tube dependent of the results of the calculations.

According to the invention, further, an X-ray apparatus is provided that has a load computer as described above. The anode in the X-ray apparatus can be a rotating anode.

Further, the surface layer of the anode of the X-ray apparatus can contain tungsten, a further layer in depth the direction can contain molybdenum, and yet another layer can contain carbon.

DESCRIPTION OF THE PREFERRED EMBODIMENTS

Before describing an inventive X-ray means, let the mathematical-physical bases of the calculation of the temperature distribution be explained first in brief.

According to the present invention, a mathematical-physical model of the anode as well as of the temperature development as a result of electron bombardment is presented, including the appertaining load computer program. The critical physical effects on which the development of heat is based are thereby taken into consideration in the inventive model. The present invention is distinguished over known load computers by taking these physical effects—explained in detail later—into consideration.

The calculating method according to the invention also allows temperature calculations to be implemented in real time, this being of great advantage in practical manipulation. As a result of this advantage, the present invention is distinguished, for example, over what are referred to as finite element calculations.

Figure 1:
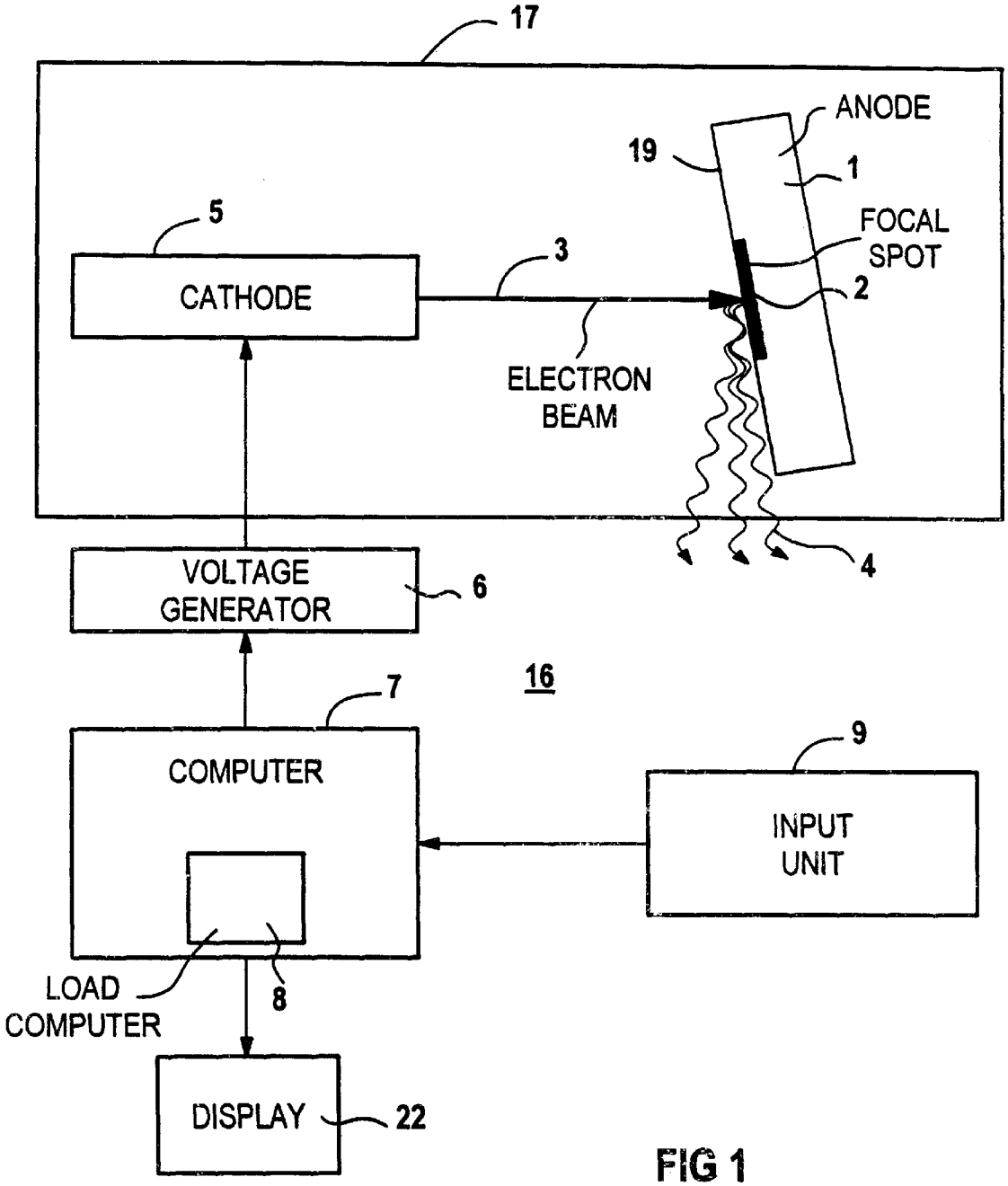
FIG. 1 shows an inventive X-ray apparatus wherein calculation of the anode load as a result of electron bombardment ensues with a load computer, and the cathode of the X-ray apparatus is correspondingly driven.

The general structure of an inventive x-ray means 16 shall now be described referring first to FIG. 1. As is known, an electron beam 3 proceeding from a cathode 5 is directed onto the surface of an anode 1 for generating x-rays 4, resulting in production of a focus spot 2 on the surface 19 of the anode. The cathode 5 as well as the anode 1 are accommodated in a housing 17. The cathode 5, as shown is driven by a generator 6 that is in turn driven by a computer 7. This computer 7 includes a load computer 8 and, in particular, has the job of permanently calculating the respective heated condition of the anode 1, for example based on the previous loads and the cooling curve (respectively following the end of a load) of the anode 1 and, for example, of supplying this as an output to a display 22 and, on the other hand, of taking the result of the calculation into consideration in the drive of the x-ray means 16 with the computer 7.

Control parameters can be entered in a known way into the computer 7 from an input unit 9, this not being described in greater detail below.

Figure 2:
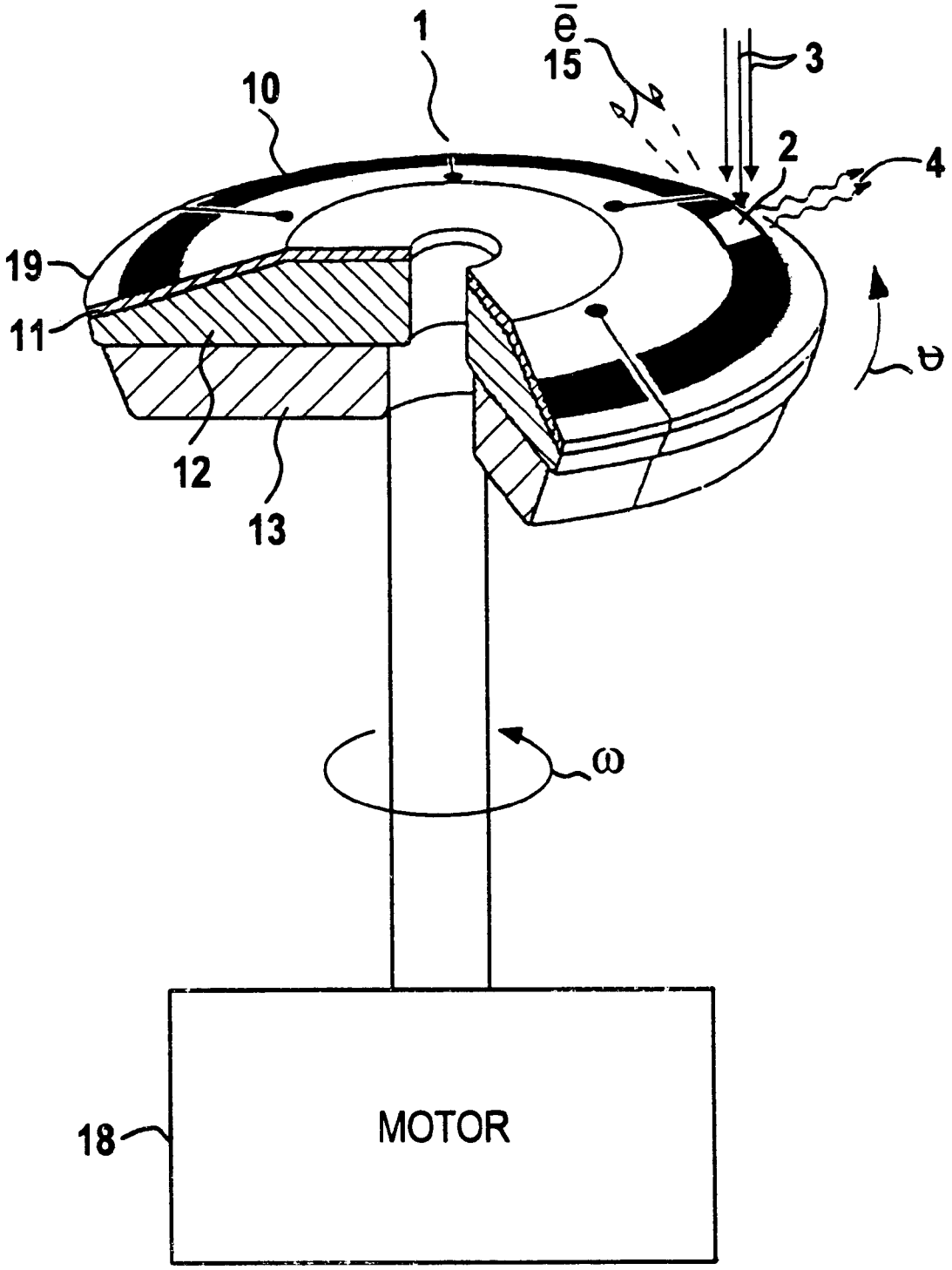
FIG. 2 shows a more detailed illustration of the generation of X-rays on a rotating anode dish of an inventive X-ray apparatus.

FIG. 2 shows the generation of x-rays 4 by electron bombardment 3 onto the surface 19 of an anode 1 in detail. The illustrated example is a rotating anode 1, i.e. the anode 1 is placed into rotational motion, for example with a motor 18 that is usually arranged outside the housing 17 of the x-ray means 16 with a velocity omega. Due to the very fast rotation of the anode dish 1, a circular focal spot path 10 is thus produced on the anode surface 19. The anode 1 shown in FIG. 2 comprises three layers 11, 12, 13 of different materials given a view in depth direction.

As already mentioned, the present invention is particularly directed to the nature of the mathematical-physical description of the temperature development of, for example, a rotating anode as a consequence of electron bombardment and the temperature control of the rotating anode of x-ray tubes that is thereby enabled in order to make an optimum utilization of the x-ray tube possible. In particular, the invention is directed to the modeling components of the overall calculation system.

According to the invention, the temperature behavior in the anode is divided into a short-term and into a long-term behavior. The following considerations thereby form the basis:

The electron beam 3 is incident on the anode surface 19 within a small region 2 of approximately 10 $mm^2$ through approximately 100 $mm^2$, whereby this small region is called focal spot 2. The dimensions of the focal spot 2, as can be seen from FIGS. 1 and 2, are comparatively small compared to the dimensions of the anode dish.

Figure 27:
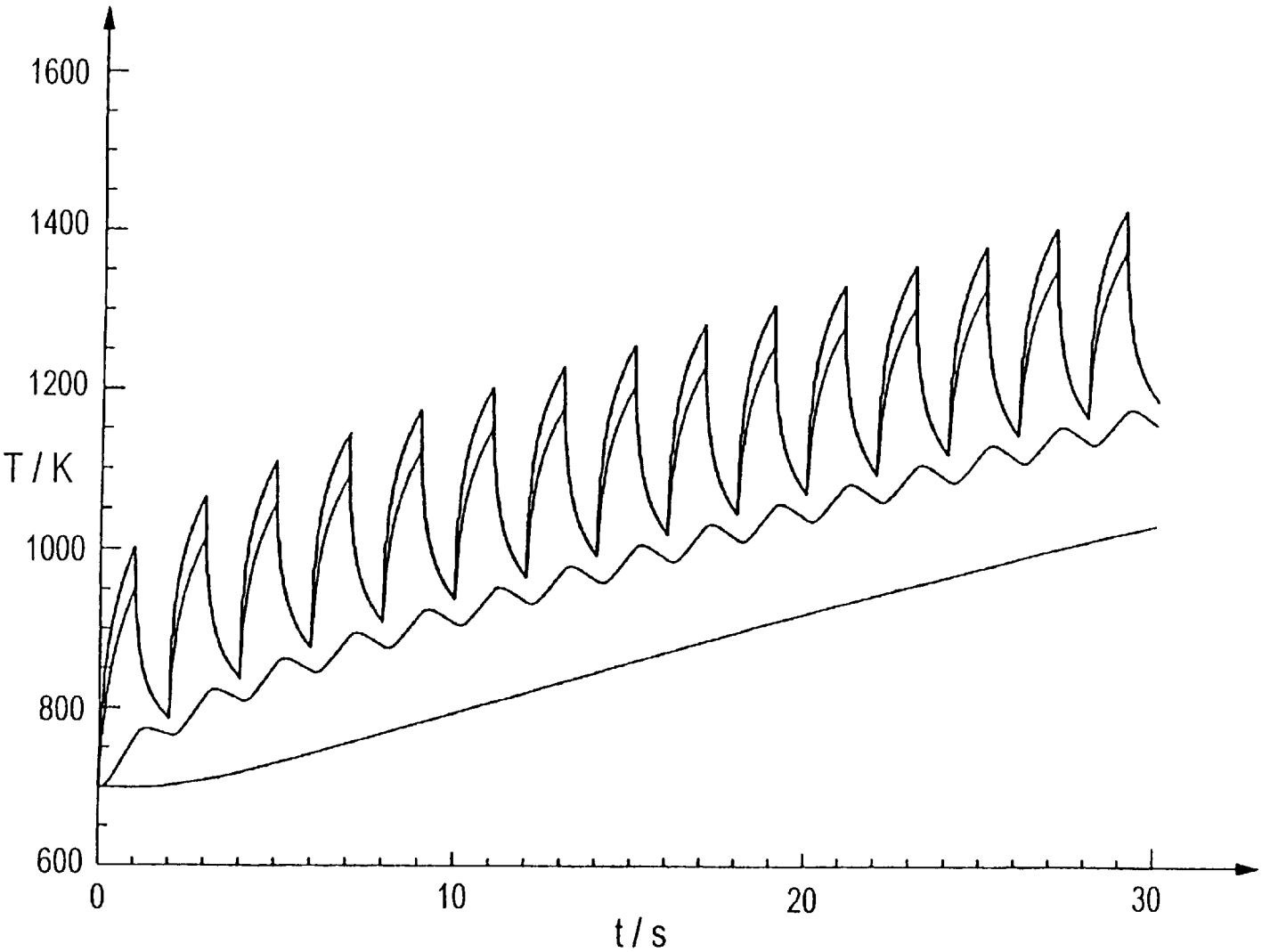
FIG. 27 shows the long-term temperature development calculated in accordance with the principles of the present invention at four different locations.

The short-term load (the time of the load of the focal spot 2) is extremely short (approximately 10 $\mu$s through approximately 100 $\mu$s) compared to the long-term load in the range of seconds (standard exposure time of image data given x-ray devices) as shown, for example, in FIG. 27.

Figure 15:
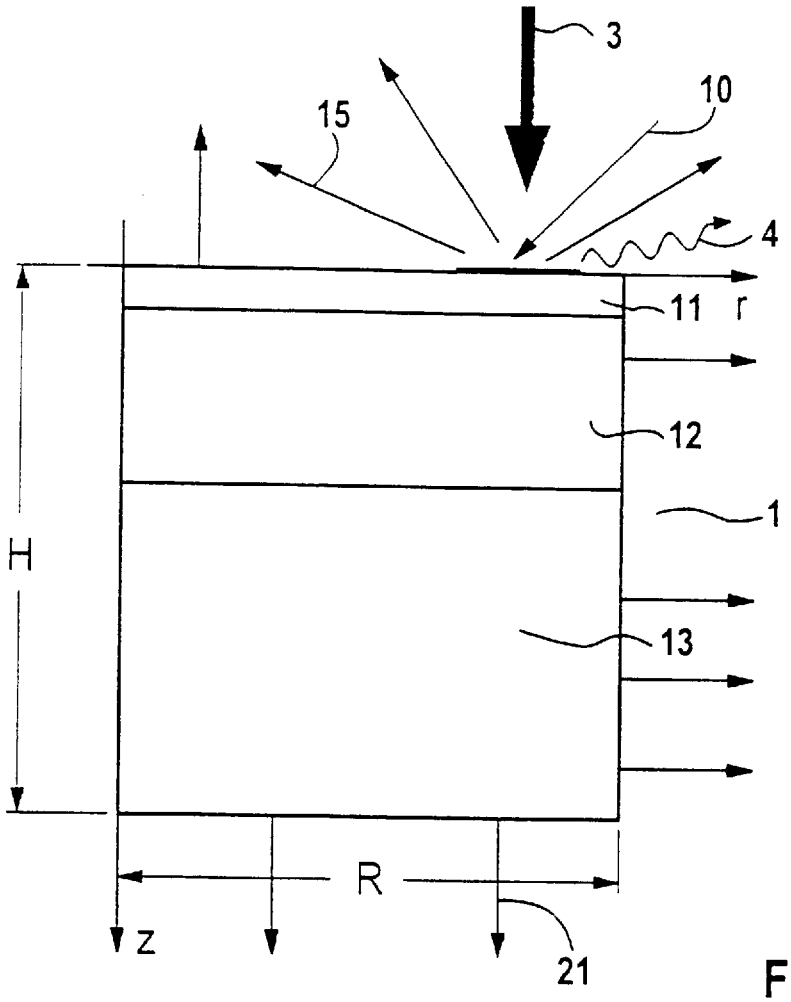
FIG. 15 is a schematic illustration of the model for calculating the temperature boost (heat development) in the anode volume given a long-term load for a tube of the type that can be employed in the present invention.

The temperature conductivity value of approximately 30 $\mu m^2/\mu s$ of the surface material, tungsten, that is usually employed thus effects that a space-time, punctiform heat force propagates approximately 100 $\mu$m deep in the anode during the electron beam load of the anode. This means that the heat pulse remains in the tungsten layer 11 itself given a standard layer thickness of the tungsten surface layer 11 of an anode 1 of, for example, one millimeter as shown in FIG. 15.

Figure 3:
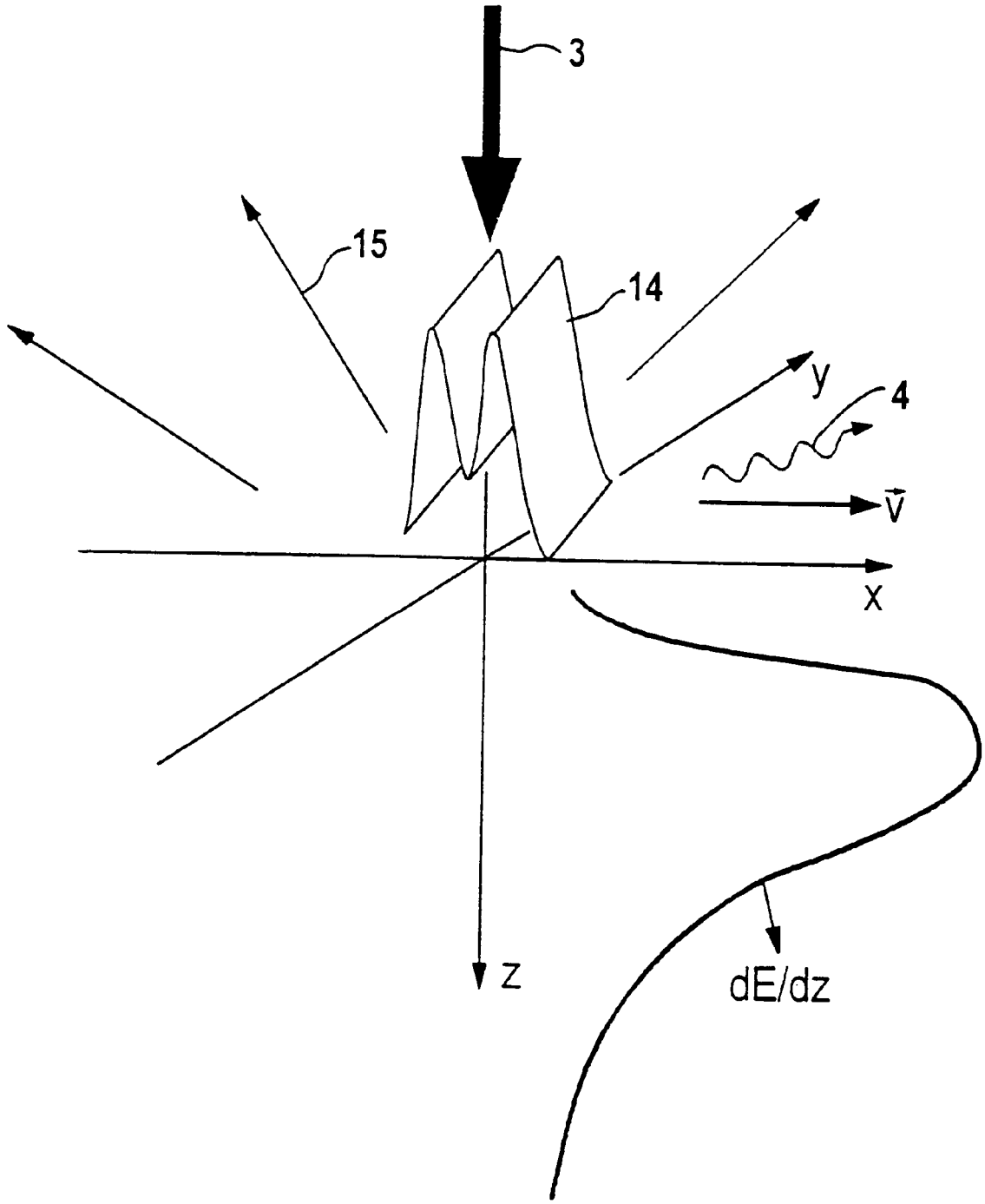
FIG. 3 is a schematic illustration of a model for calculating the temperature boost in the focal spot (short-term load) in accordance with the invention.

The temperature boost, the maximum focus spot temperature boost, the maximum focus spot temperature achieved at the end of the load, derives from the spatial and temporal superimposition of punctiform heat pulses in space and time that are generated during the load time as a result of the energy dissipation of the electrons in the entire three-dimensional focus spot region (on the anode surface and the depth region lying therebelow according to FIG. 3 wherein the depth-dependent generation of heat is shown over the infinite half space (uHR) of tungsten).

A heat pulse has thus propagated approximately 8 mm into the anode during a scan having a duration of one second.

Correspondingly, a heat pulse given a scan duration of twenty seconds has propagated approximately 30 mm deep into the anode and, thus, into the other layers 12, 13 of the anode as well. The heat propagation in the entire anode volume must thus be taken into consideration in the long-term view.

The calculation of the space-time temperature distribution in the anode 1 is composed of two separate calculations. On the one hand, the short-temperature boost in and around the focal spot during and immediately after the corresponding, brief-duration electron bombardment of the focal spot is taken into consideration. Further, the space-time temperature distribution in the entire anode volume as a consequence of the (comparatively slow) heat propagation that emanates from the moving focal spot (rotating anode) and as a consequence of the heat emission from the anode surface is taken into consideration.

The calculation model for the short-term load shall be explained first.

The calculation of the heat propagation and, thus, of the temperature distribution ensues in a homogeneous, three-dimensional, thermally conductive, infinite half space (uHR) whose material parameters are defined by the material of the surface layer of an anode, for example tungsten. The three-dimensional heat flow is thus taken into consideration. The following, general thermal conduction equation thus applies for a homogeneous heat conductor $$\left[\frac{\partial}{\partial t} - D\Delta\right]T(t, \vec{r}) = \frac{q(t, \vec{r})}{\rho c_p}$$

$$\frac{\partial}{\partial t}(c_p(T, z)\rho(z)T(t, \vec{r})) = \nabla \cdot (\lambda(T, z)\nabla T(t, \vec{r}) + q(t, \vec{r})$$

| | |
|---|---|
| $\rho$ | density |
| $c_p$ | specific heat capacity (temperature-dependent) |
| $\lambda$ | thermal conductivity (temperature-dependent) |
| $D = \frac{\lambda}{\rho c_p}$ | Temperature conductivity |
| $T(t, \vec{r})$ | space-time temperature field |
| $q(t, \vec{r})$ | heat source function |
| $\vec{r} = (x, y, z)$ | location vector |

This equation is solved using Green's function. Green's function is the solution of the thermal conduction equation for a heat source that is punctiform in space and time. Given production of heat in a spatial region during a time interval, the amounts of these punctiform heat sources (heat pulses) are summed up weighted by their intensity.

On the basis of Green's function (G(t, $\vec{r}$,t', $\vec{r}$'), which is described in Chapter 7 of the book "Methods of Theoretical Physics" by Morse et al, McGraw Book Company, New York, 1953, the temperature expression reads:

$$T(t, \vec{r}) = \frac{1}{\rho c_p}\int_{t_o}^{t} dt' \int_{uHR} d\vec{r}'\, G(t, \vec{r}, t', \vec{r}')q(t', \vec{r}')$$

Green's function describes an effect at the location $\vec{r}$ at the time t as a consequence of a cause at the location $\vec{r}$' at the time t'. Due to this causality, t>t' must apply. The broken-line quantities indicate point-in-time and location of the above-described production of heat. The integration extends over the entire time of the heat generation (heat load) and over all locations of the heat generation.

Figure 4:
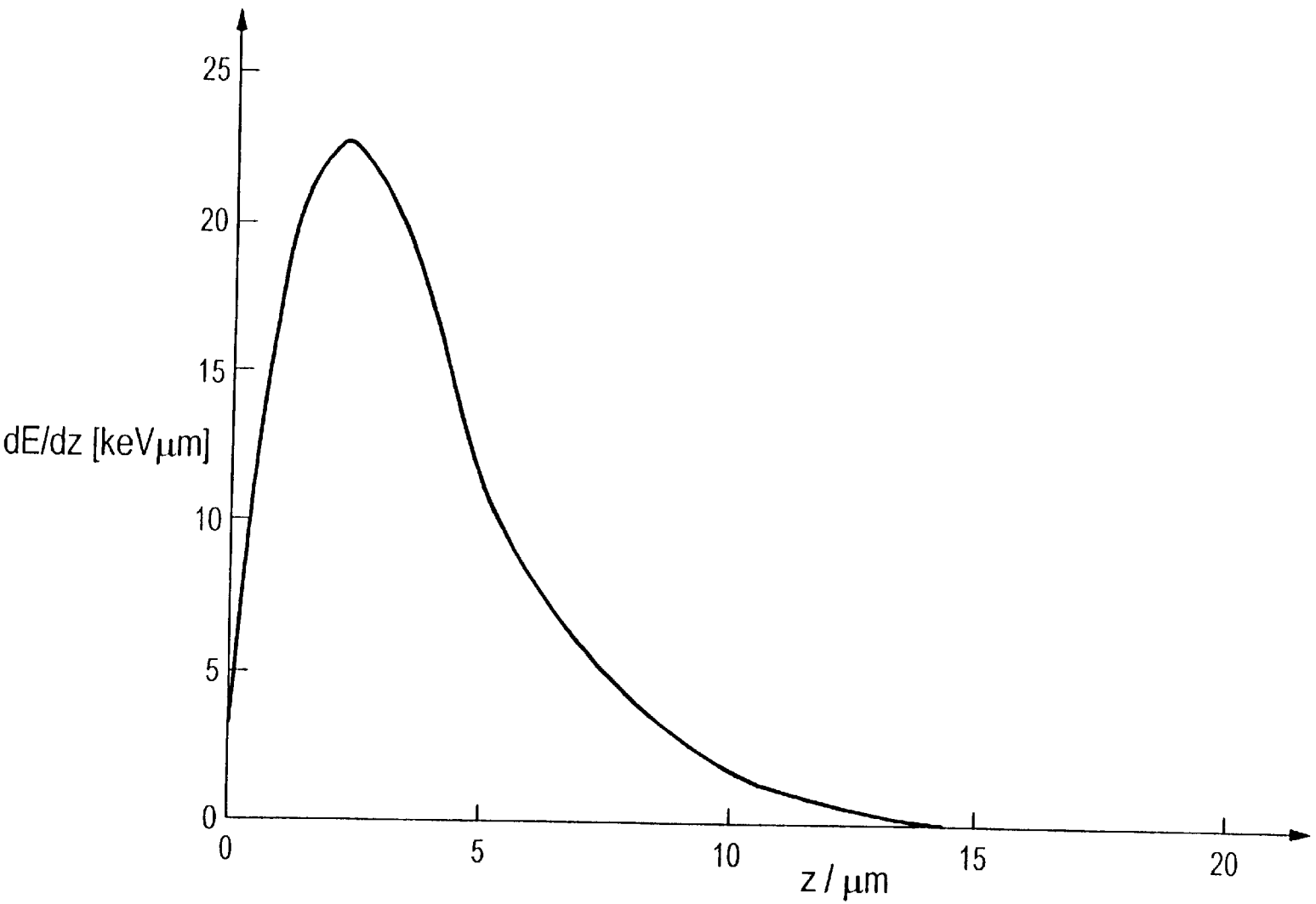
FIG. 4 shows the energy dissipation of 120 KeV electrons in tungsten, calculated from the modeled assumptions of energy loss of the electrons along the path according to Bethe, conversion into depth coordinates and weighting with range distribution, in accordance with the invention.

The following physical effects are introduced according to the invention for the short-term domain:

the back scatter of the electrons, the three-dimensional heat flow as a result of the description of the tungsten layer as thermally conductive, three-dimensional, infinite half space, the energy loss of the electrons in the depth (z) of the anode material (energy dissipation $$\frac{dE}{dz},$$

see FIG. 4), the movement of the beam profile given a rotating anode and/or potentially, the inhomogeneity of the beam profile.

The back scatter of a part of the electrons incident onto the focal spot, this being referenced 15 in FIG. 3, reduces the power supplied to the anode 1 by the electron beam. This reduction in the power supply to the anode 1 is taken into consideration in the inventive calculation on the basis of a multiplicative factor 1−η with η as back scatter coefficient that reduces the supplied radiant power.

The energy dissipation is composed of three contributions:

1. The energy loss $$\frac{dE}{dz}$$

of the electrons in the heat conductor along their path a consequence of excitation of the atoms and ionization according to what is referred to as the Bethe formula;

2. The relationship between path length and range of the electrons; and

3. The distribution of the penetration depths (R) of the electrons.

The energy dissipation equation resulting therefrom is a weighted sum over all penetration depths: With $R_{min}$ and $R_{max}$ as $$\frac{d\varepsilon}{dz} = \int_{R_{\min}}^{R_{\max}} dR' g(R') \frac{d\tilde{E}_{R'}}{dz}$$

minimum and maximum penetration depths.

The beam profile is the intensity of the electron beam on the focal spot area. For electron-optical reasons, this intensity distribution is generally not uniform.

The profile of the electron beam 14 in FIG. 3 comprises a "double hump" structure. By discretizing the focus spot area into rectangular surface elements, inhomogeneous beam profiles (intensity distribution) can be modeled.

The occupation of the beam profile, the topical dependency of the function P(t, x, y) is defined by the electron-optical relationships in the x-ray tube. The occupation can be photometrically measured as may be derived, for example, from the book "Bildgebende Systeme fur die medizinische Diagnostik", edited by H. Morneburg, third edition, 1995, pages 236ff.

The time dependency of the function p(t,x,y) allows the movement of the beam profile given a rotating anode and, thus, the movement of the beam over the anode surface and the duration of the irradiation to be described. The heat source function reads:

$$q(t', \vec{r}) = p(t'xx', y')\frac{1}{\varepsilon_0}\frac{d\varepsilon}{dz'}$$

with $\vec{r}$=(x', y', z') as vector for the location of the heat generation and $\epsilon_0$ as beam energy.

The heat generation in the anode material is essentially determined by the energy loss of the electrons in the anode, as shown in FIGS. 3 and 4. According to the invention, this depth-dependent energy loss is described by a phenomological model. This model comprises the following features.

1. The conversion of the energy loss per path element as a result of excitation and ionization of atoms along the path of the electron onto the energy loss per path element along the range distance of the electron taking the energy preservation rule into consideration; and
2. The weighting of said energy loss per path element with the range distribution for the electron energy onto consideration, as a result whereof the heat-generating energy loss along the depth direction and, thus, the heat source function according to FIG. 4 derives.

The beam profile movement is taken into consideration in that the heat source function is topically modified according to the profile movement, i.e. the relative movement between the beam and the anode.

Figure 5:
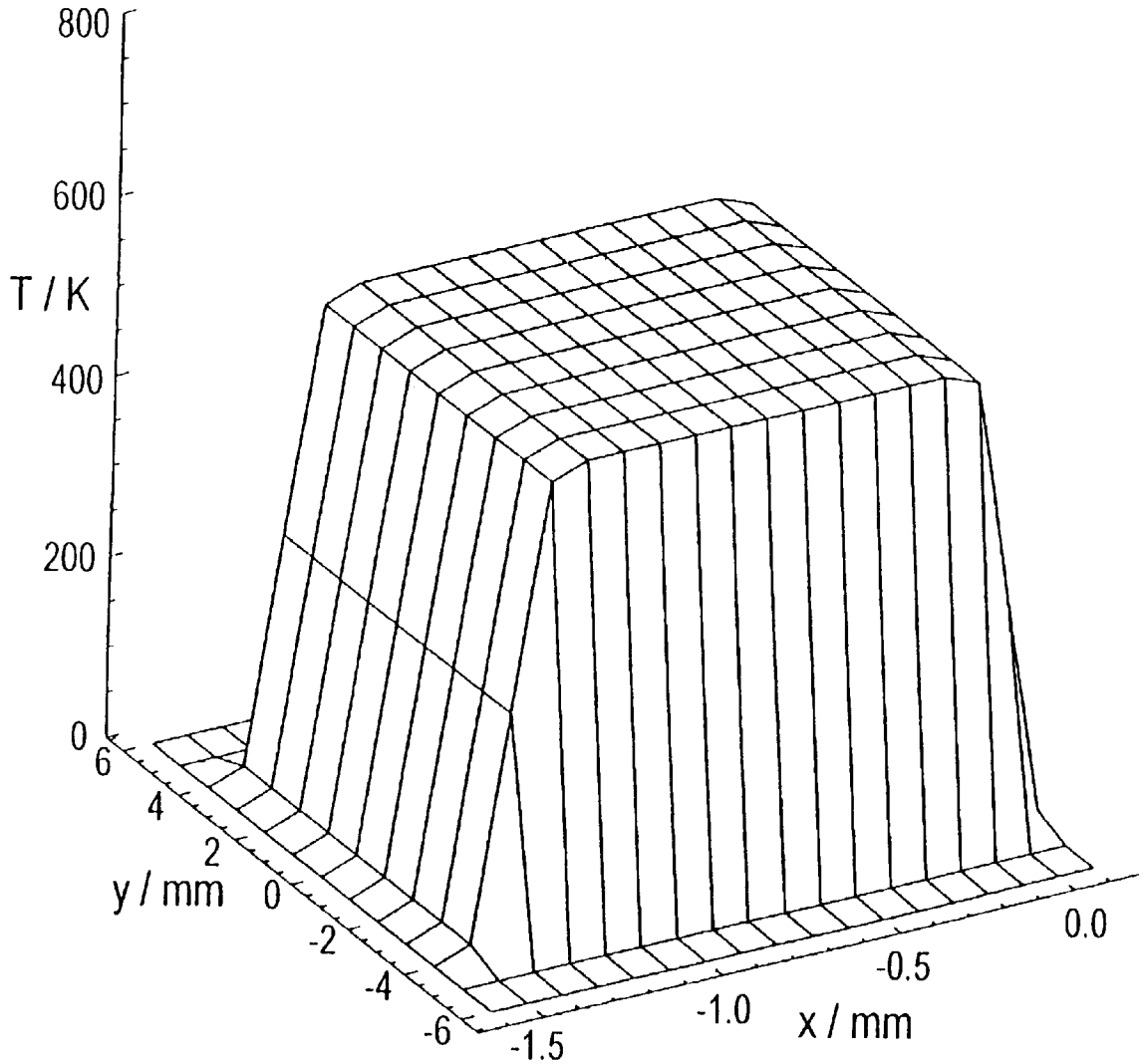
FIG. 5 shows the result of the temperature boost calculation in and directly around the focal spot, showing the temperature distribution in the focal spot, i.e. on the anode surface (z=0), at the end of the radiation load given a stationary, homogeneous, rectangular beam profile, in accordance with principles of the present invention.
Figure 6:
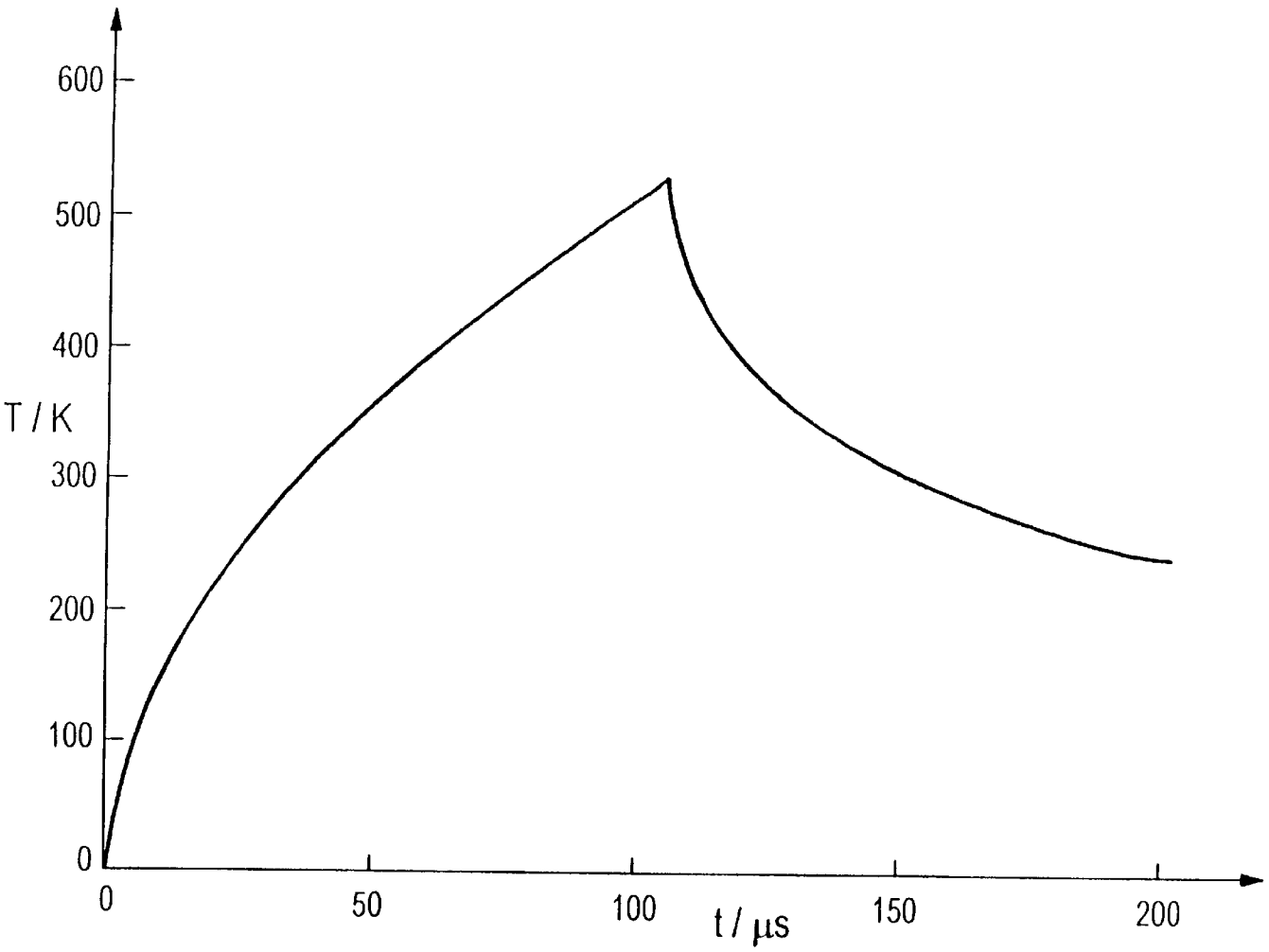
FIG. 6 shows the result of the temperature boost calculation in and directly around the focal spot showing the temporal temperature boost development in the focal spot center (anode surface) given a stationary, homogeneous beam profile during and after the load, in accordance with the principles of the present invention.
Figure 7:
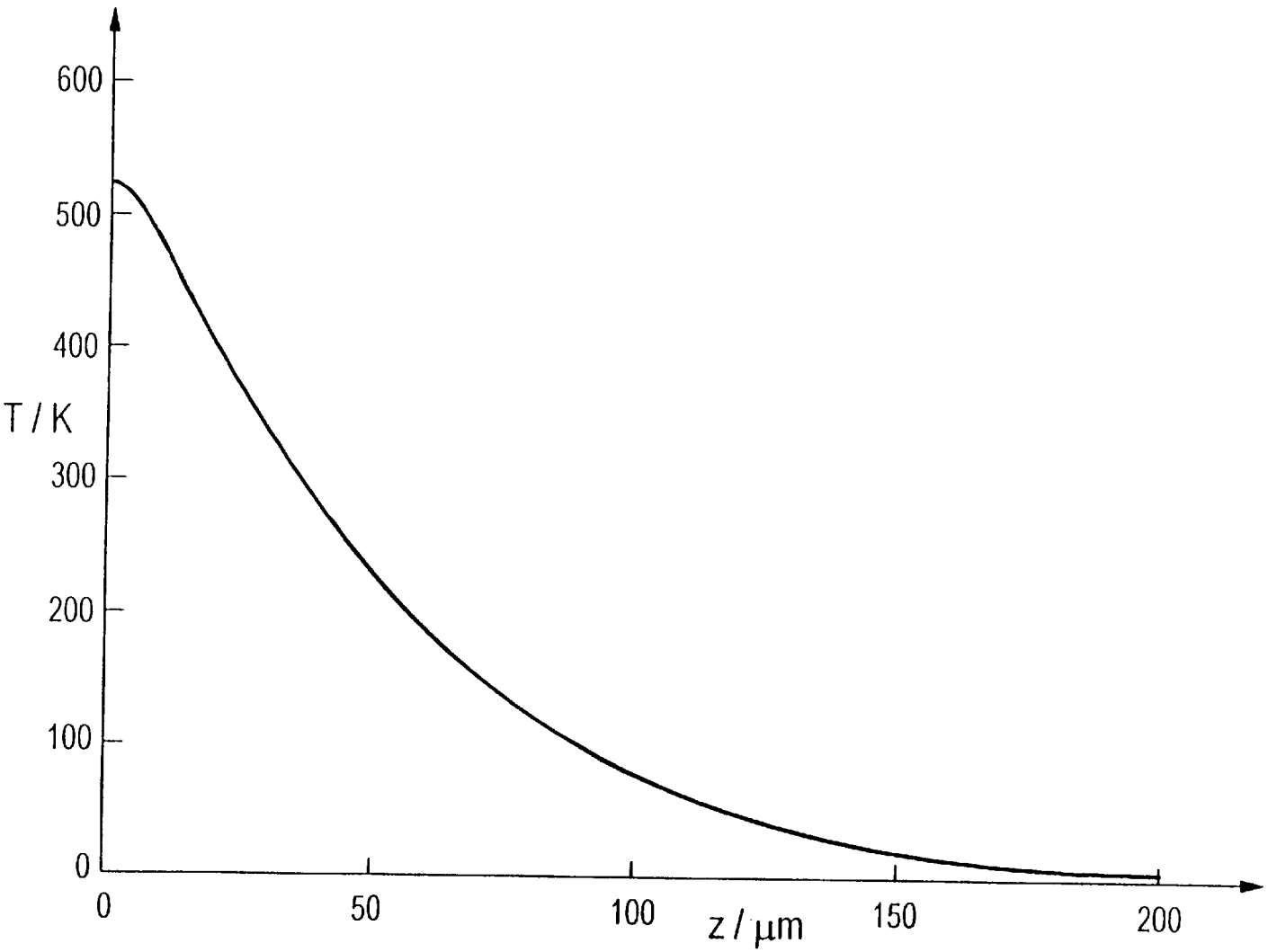
FIG. 7 shows the result of the temperature boost calculation in and directly around the focal spot showing the spatial (depth direction) temperature boost development at the end of the radiation load given a stationary, homogeneous beam profile at the end of the load in accordance with the principles of the present invention.
Figure 8:
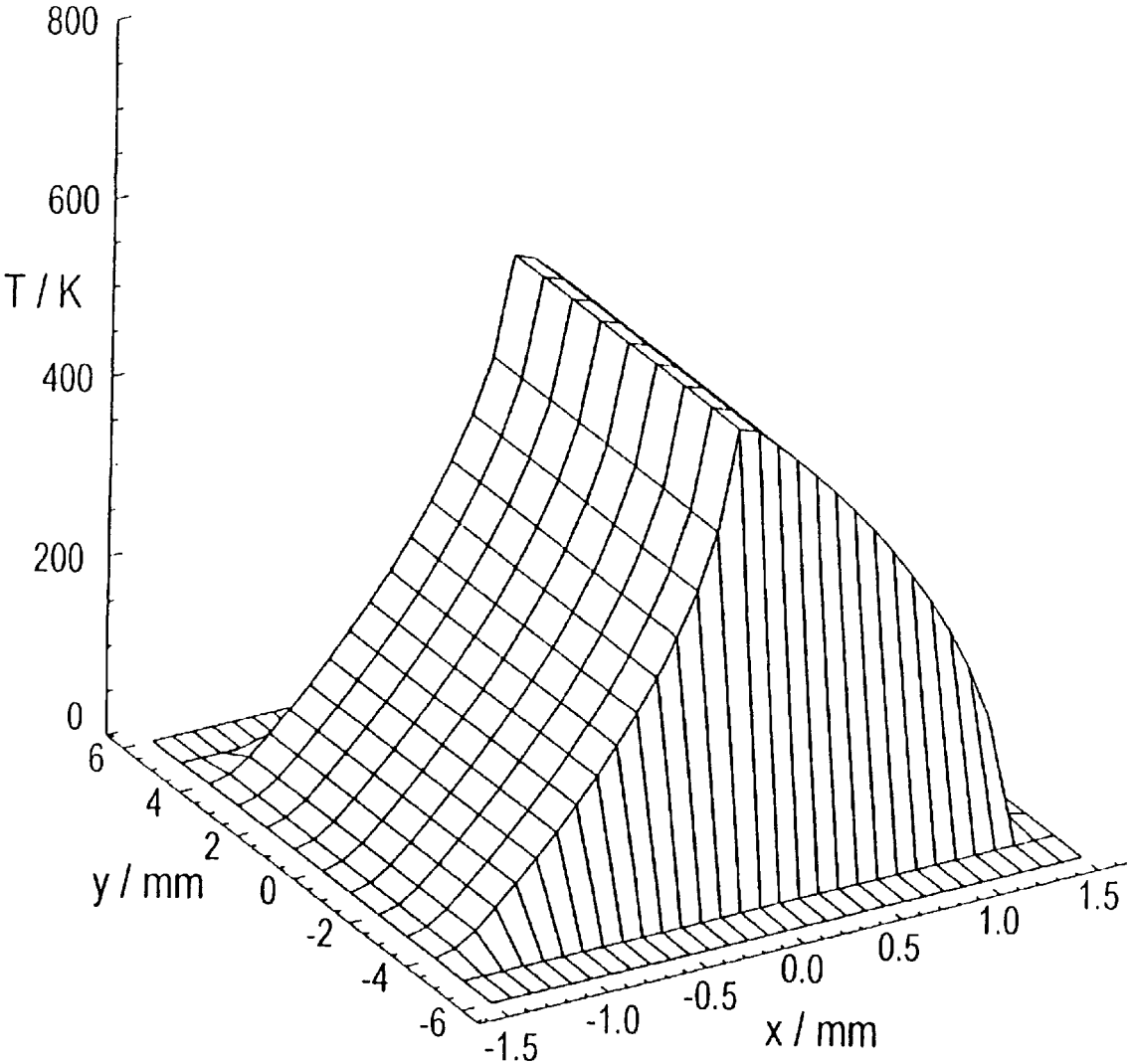
FIG. 8 shows the result of the temperature boost calculation in and directly around the focal spot as the temperature distribution in the focal spot, i.e. on the anode surface (z=0), at the end of the radiation load given a moving, homogeneous, rectangular beam profile (rotating anode), in accordance with the principles of the present invention.
Figure 9:
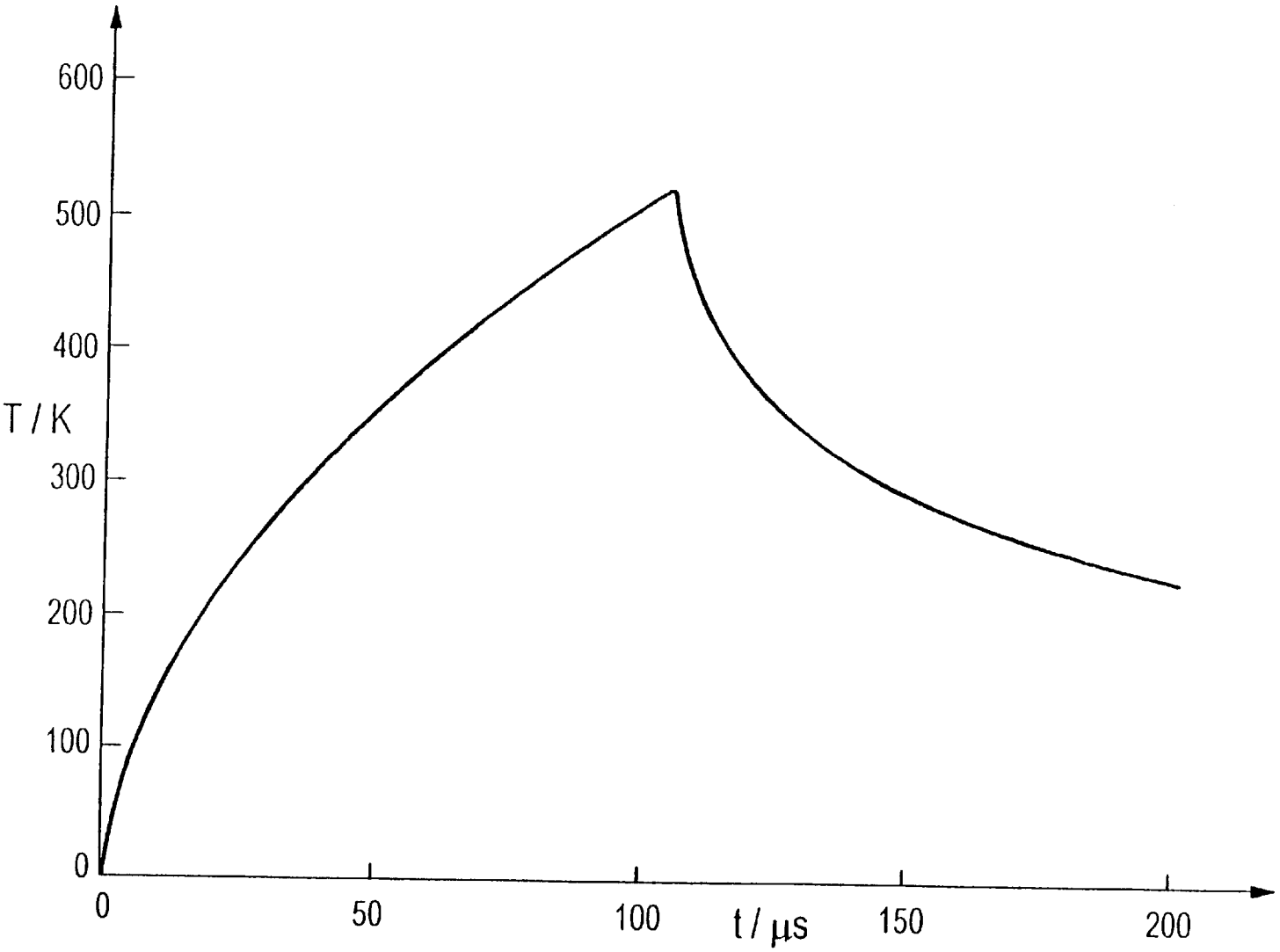
FIG. 9 shows the result of the temperature boost calculation in and directly around the focal spot as a temporal temperature boost development in the focal spot center (anode surface) given a moving, homogeneous beam profile (rotating anode) during and after the loading, in accordance with the principles of the present invention.
Figure 10:
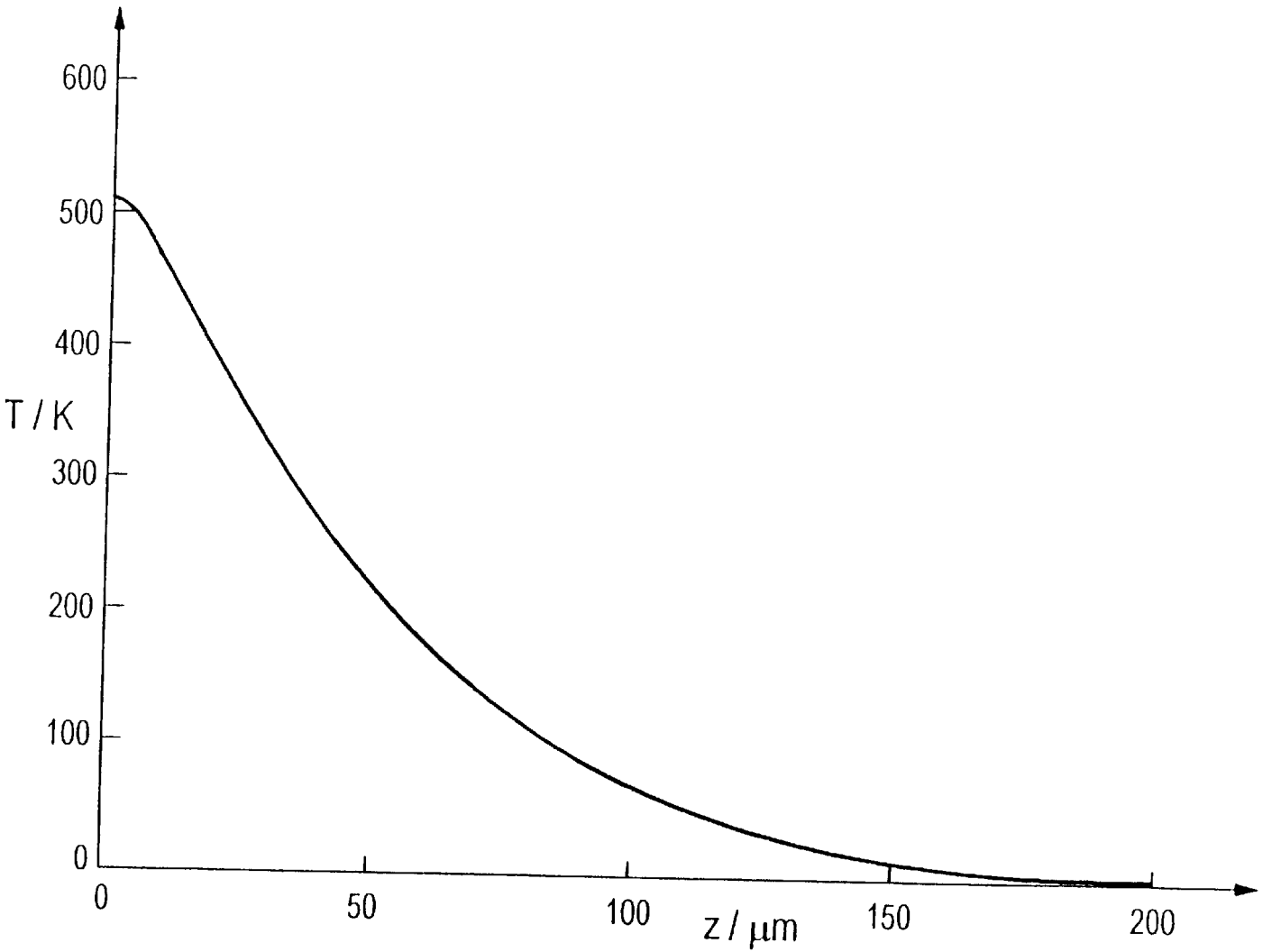
FIG. 10 shows the result of the temperature boost calculation as a spatial (depth direction) temperature boost development at the end of the radiation load given a moving, homogeneous beam profile (rotating anode) at the end of the radiation load, in accordance with the principles of the present invention.
Figure 11:
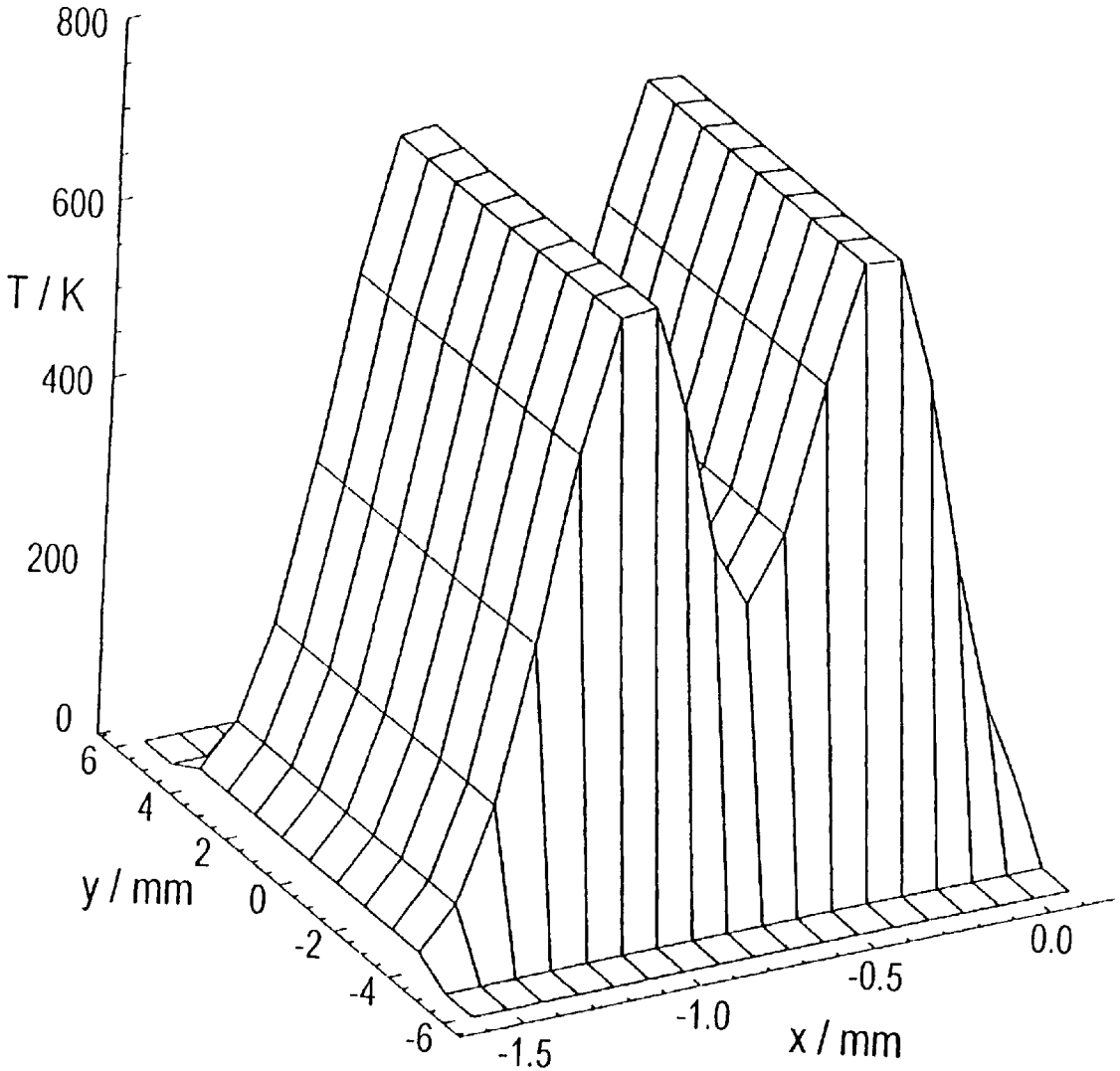
FIG. 11 shows the result of the temperature boost calculation in and directly around the focal spot as a temperature distribution in the focal spot, i.e. on the anode surface (z=0) at the end of the radiation load given a stationary, inhomogeneous beam profile (double Gaussian profile), in accordance with the principles of the present invention.
Figure 12:
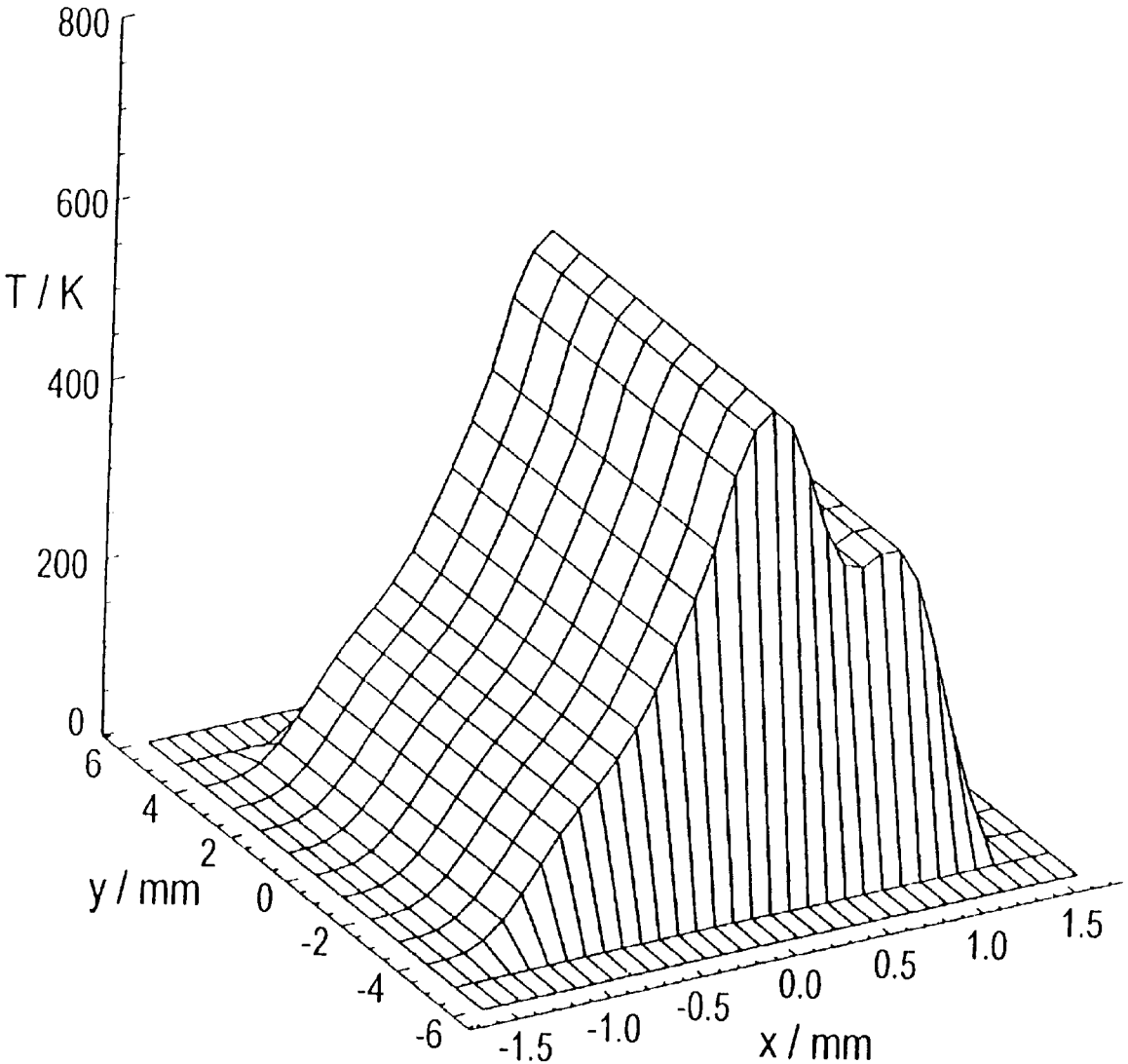
FIG. 12 shows the result of the temperature boost calculation in and directly around the focal spot as temperature distribution in the focal spot, i.e., on the anode surface (z=0) at the end of the beam load, given a moving, inhomogeneous (double Gaussian profile) beam profile, in accordance with the principles of the present invention.
Figure 13:
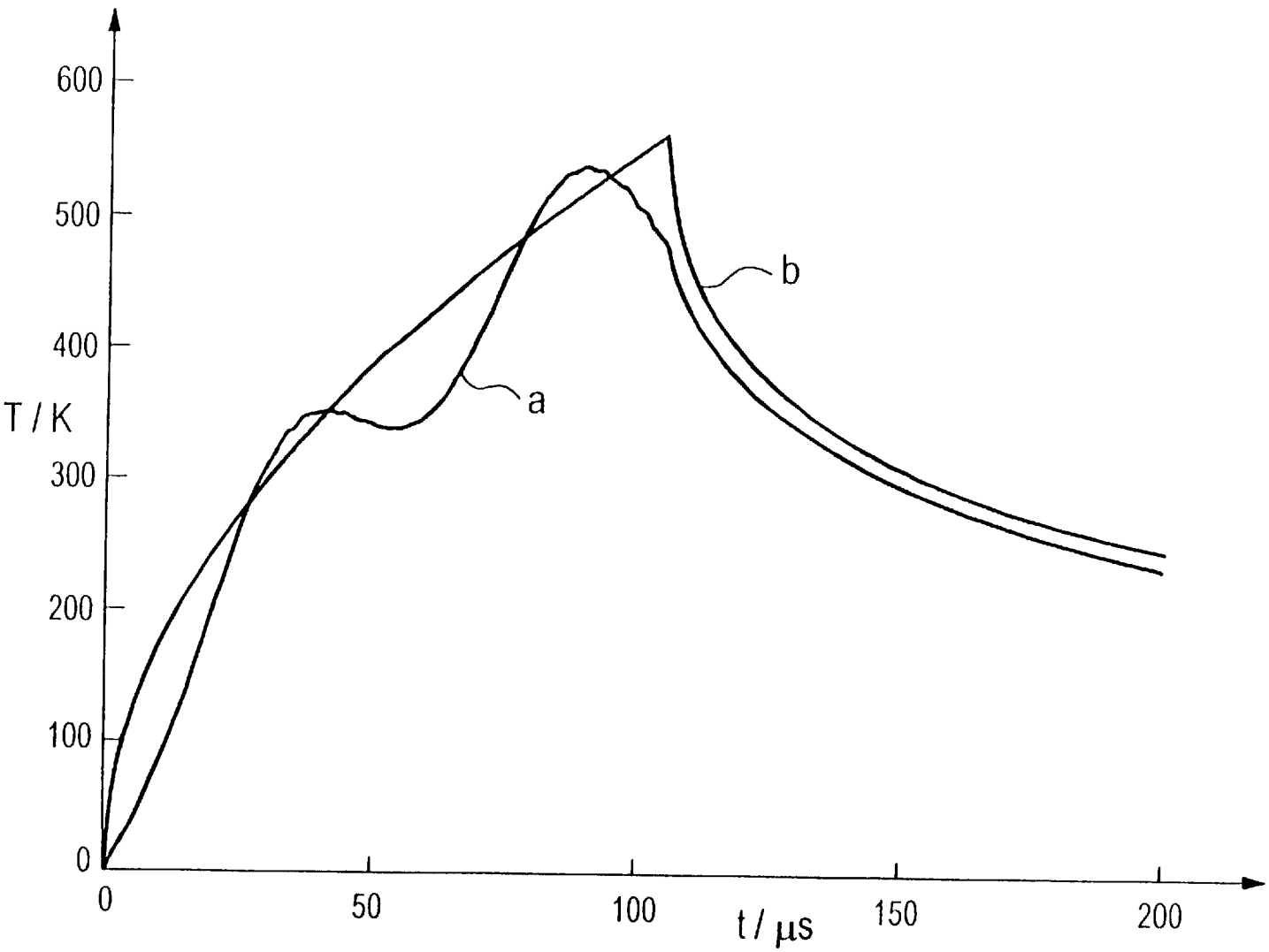
FIG. 13 shows the result of the temperature boost calculation in and immediately around the focal spot as a temporal temperature boost development in the center of the focal spot (anode surface) given a moving, inhomogeneous (double Gaussian profile) beam profile (a) as well as a comparison of the temperature curve given moving, homogeneous beam profile (b) during and after the load, in accordance with the principles of the present invention.
Figure 14:
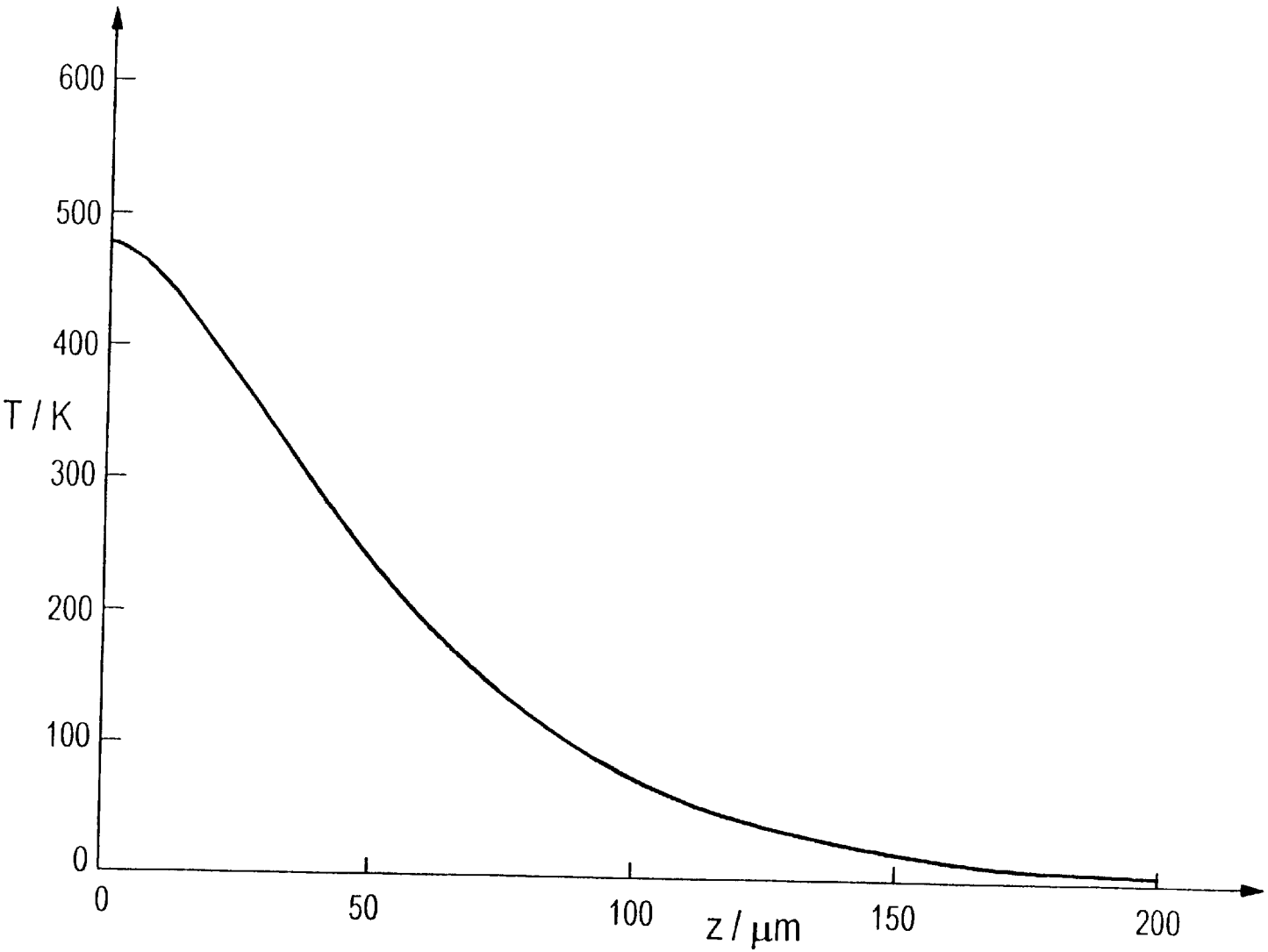
FIG. 14 shows the result of the temperature boost calculation in and immediately around the focal spot as a spatial (depth direction) temperature boost development at the end of the radiation load, given a moving, inhomogeneous (double Gaussian profile) beam profile after the load, in accordance with the principles of the present invention.

The inhomogeneity of the beam profile is taken into consideration in that the focal spot area is discretized and the individual surface elements then have power area/density values allocated to them corresponding to the profile intensity distribution to be described. The temperature profiles of FIG. 5 and FIG. 11 indirectly show possibilities of beam profile inhomogeneities. Maximum temperatures of $T_{max}$= 522.7 K in FIG. 5 and $T_{max}$=692.74 K in FIG. 11 were thereby assumed.

Figure 21:
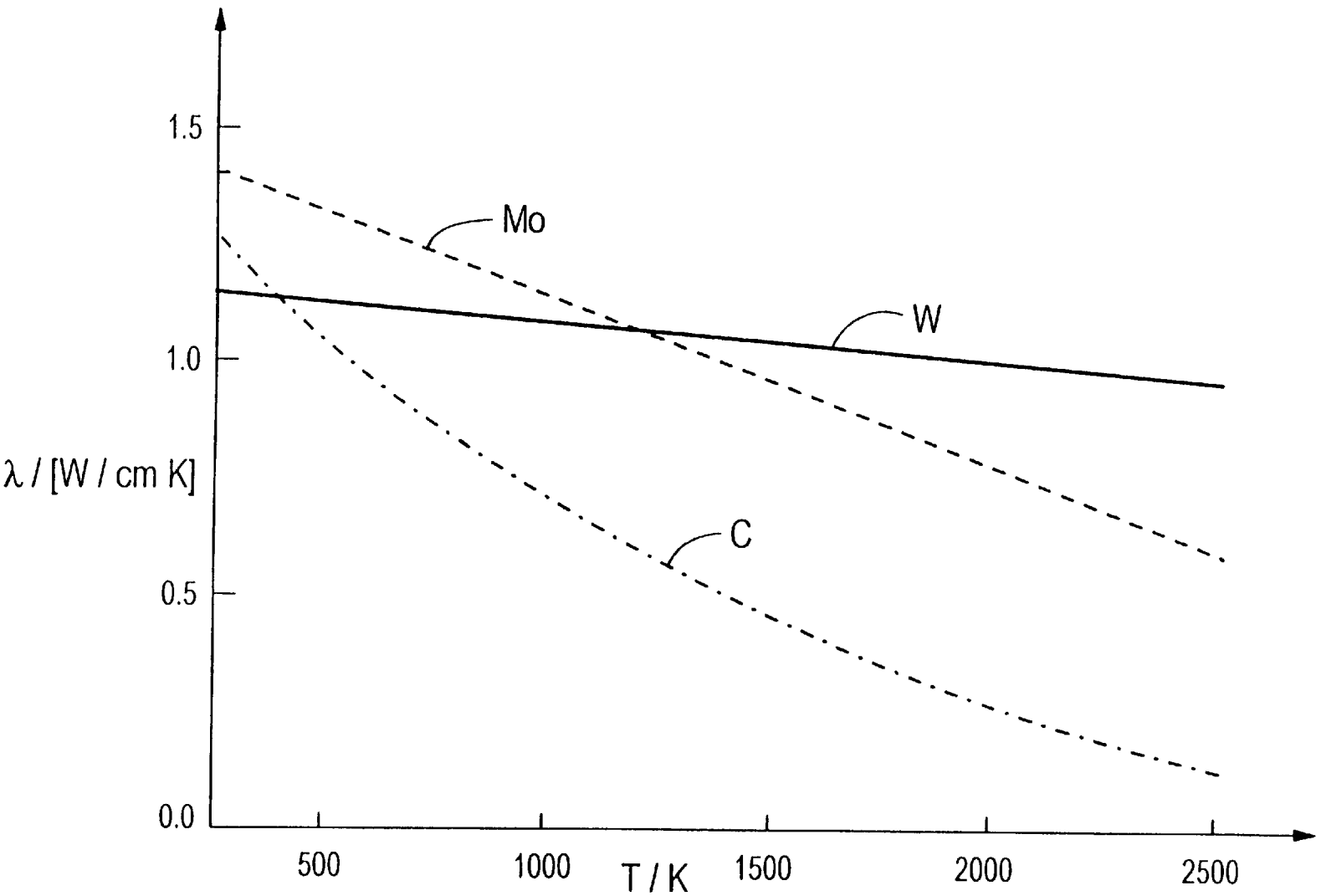
FIG. 21 shows the temperature behavior of the thermal conductivity $\lambda$.
Figure 22:
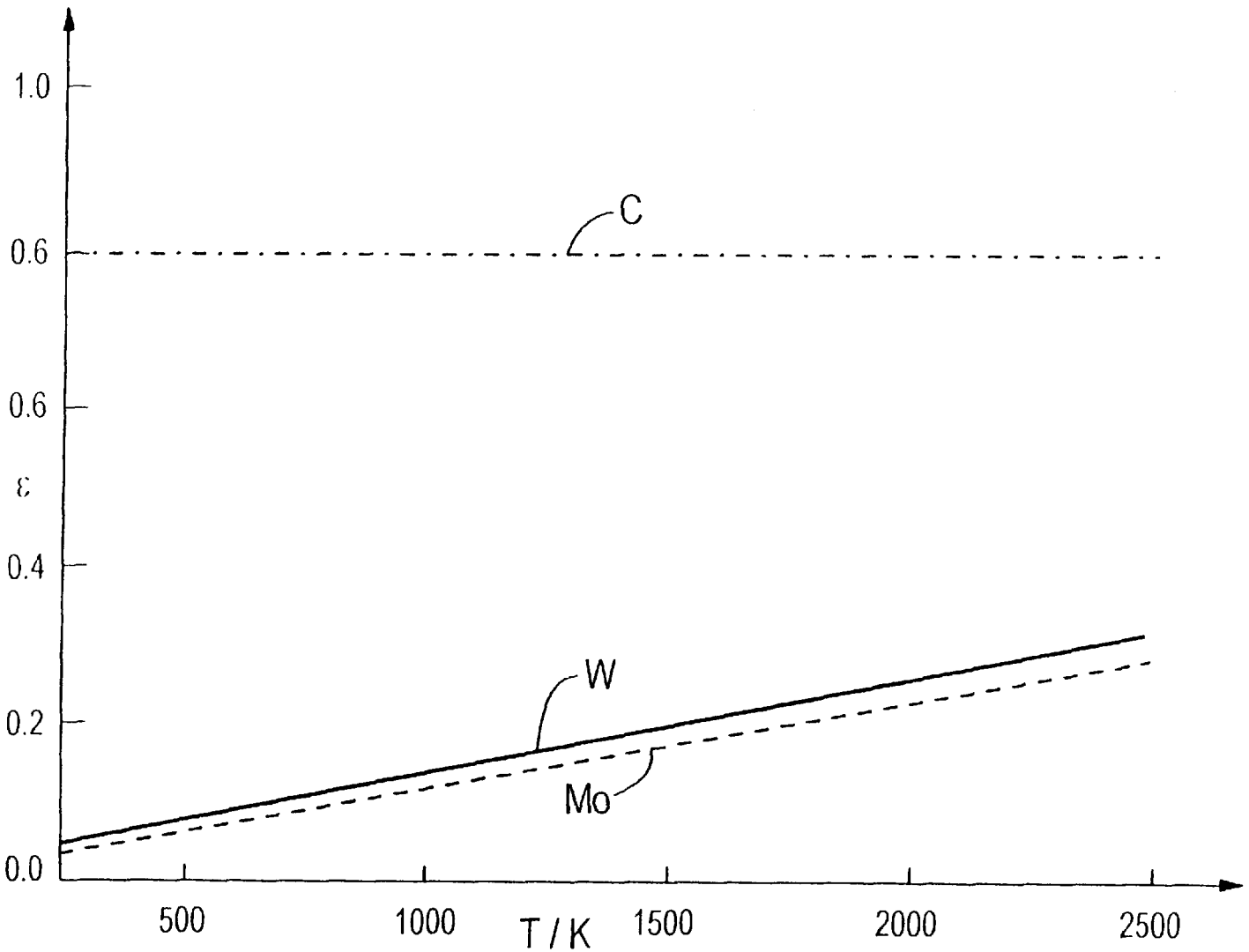
FIG. 22 shows the temperature behavior of the emissivity $\epsilon$.
Figure 23:
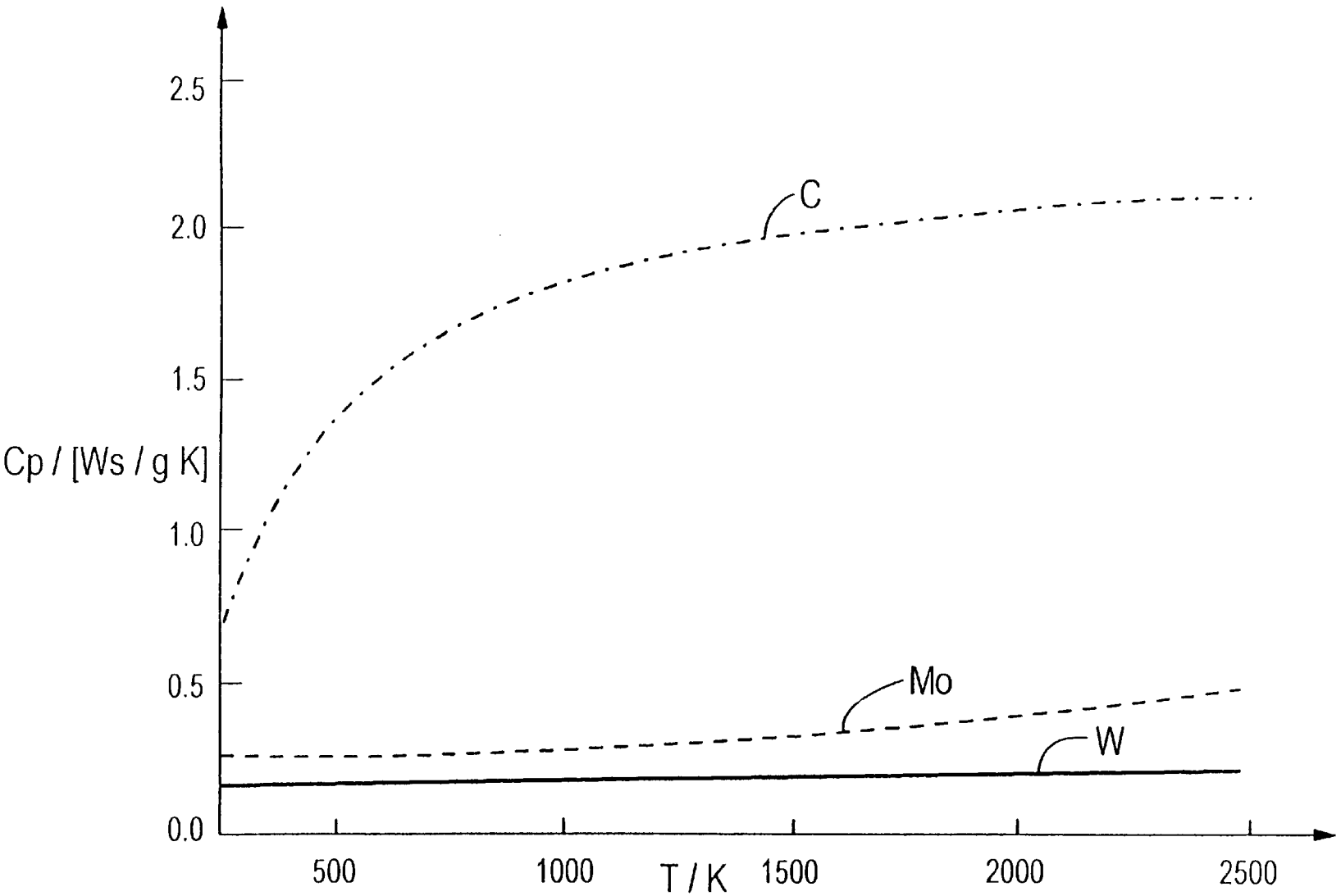
FIG. 23 shows the temperature bahavior of the specific heat capacity $c_p$.
Figure 24:
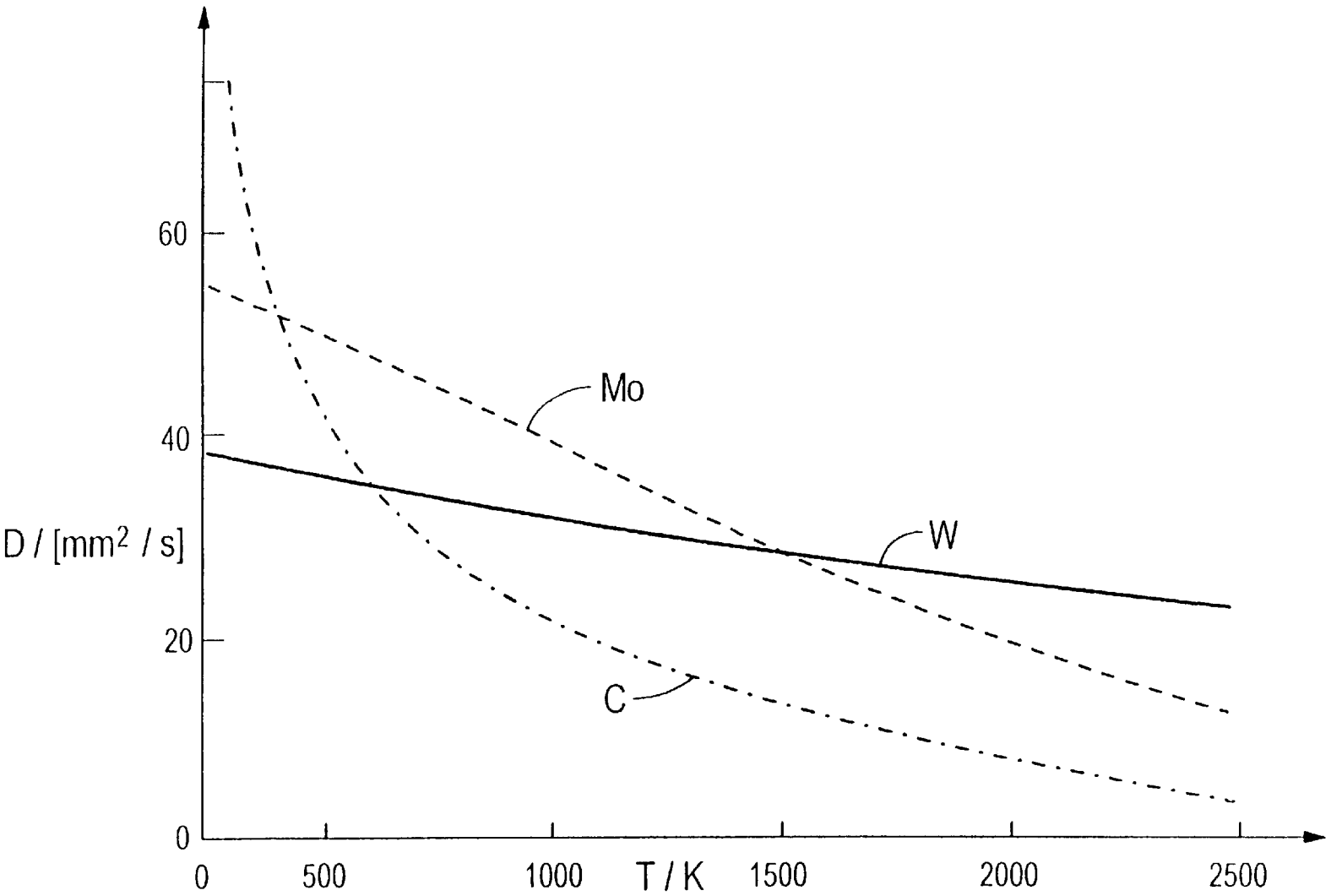
FIG. 24 shows the temperature behavior of the diffusion parameter D for tungsten (W), molybdenum (Mo) and graphite (C).
Figure 25:
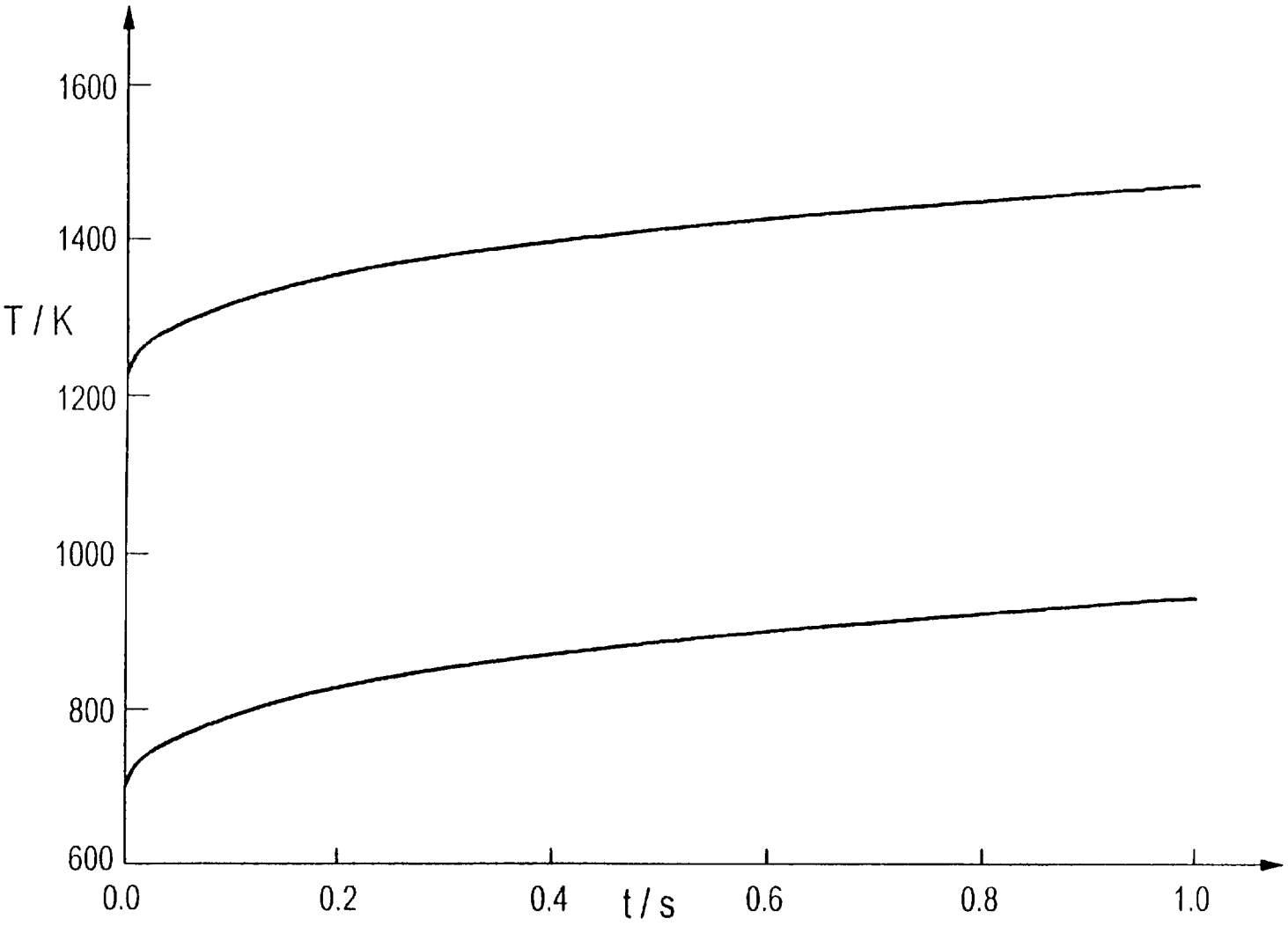
FIG. 25 shows the result of the temperature boost calculation in the center of the focal ring (radial middle position of the focal spot path) given a continuous load with and without taking the short-term temperature boost into consideration.

The calculation model shall now be explained in view of the long-term load on the basis of the physical effects that are involved and are relevant in this time range. The effects taken into consideration according to the invention are:

The back scatter of the electrons;

The three-dimensional heat flow on the basis of the description of the anode volume as cylinder 20 (see FIG. 15) with a radius R of, for example, 50 mm and the height H that is composed of a plurality of layers 11, 12, 13 of various materials, for example of tungsten (W) having a thickness of 1 mm, molybdenum (Mo) having a thickness of 8 mm and graphite (C) having a thickness of 21 mm;

The radiation exchange (emission 21 in FIG. 15) between the anode surface 19 and the housing according to the Stefan-Boltzmann law (see FIGS. 19 and 20); and/or The temperature dependency of the material parameters such as, for example, the thermal conductivity (FIG. 21), the emissivity (FIG. 22), the specific heat capacity (FIG. 23) as well as diffusion parameters (FIG. 24) of the various materials.

The backscatter 15 of a part of the electrons 3 incident onto the circulating focal spot 2 in turn reduces the power supply to the anode 1. This reduction is taken into consideration in the calculation by a multiplicative factor $\leqq 1$, as a result whereof the factor thus reduces the supplied radiant power. This factor generally differs from the multiplicative factor of the backscatter of the short-term load since it must be taken into consideration in the long-term load that a part of the electrons 15 backscattered at a location is incident again onto the anode 1 at a different location. The multiplicative factor of the long-term load is thus usually greater than that of the short-term load.

As a result of the focal spot (see FIG. 2) circulating on a circular path a uniform temperature distribution (except for the focal spot region 2) along the focal spot path already occurs after a few revolutions (maximally 10) and, thus, an axially-symmetrical, three-dimensional temperature distribution in the anode volume occurs. This three-dimensional distribution can be calculated in a two-dimensional cylinder (see FIG. 15, dependent coordinates: radial and depth coordinates). This cylinder 20 is layered in depth (see the layers 11, 12, 13 in FIG. 15). The calculation is comprised in the solution of the general, inhomogeneous thermal conduction equation in the aforementioned two-dimensional cylinder 20 on the basis of what is referred to as the finite difference method.

$$\frac{\partial}{\partial t}(c_p(T, z)p(z)T(t, \vec{r})) = \nabla T(t, \vec{r})) + q(t, \vec{r})$$

| | |
|---|---|
| $\rho$ | density function |
| $c_p(T, z)$ | specific heat capacity (temperature-dependent) |
| $\lambda(T, z)$ | thermal conductivity (temperature-dependent) |
| $T(t, \vec{r})$ | space-time temperature field |
| $q(t, \vec{r})$ | heat source function |
| $\vec{r} = (x, y, z)$ | location vector |

Figure 17:
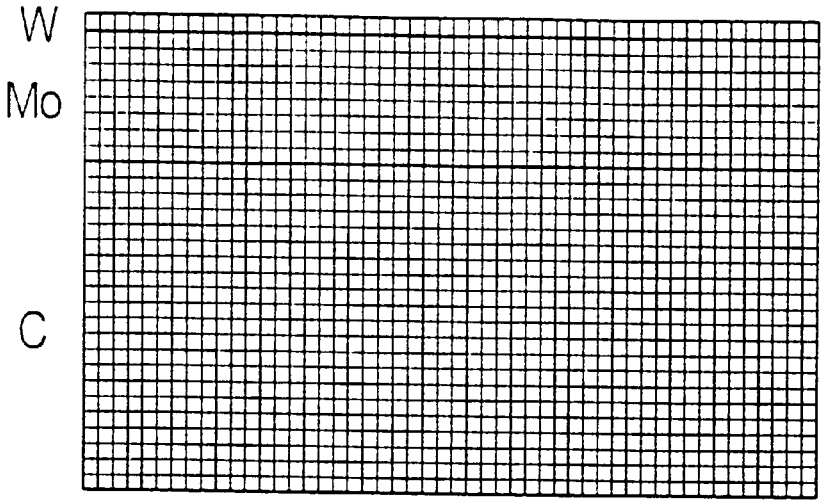
FIG. 17 shows the equidistant division of the cylinder region into discrete portions for taking, for example, inhomogeneities of the anode material into consideration, in accordance with the principles of the present invention.
Figure 18:
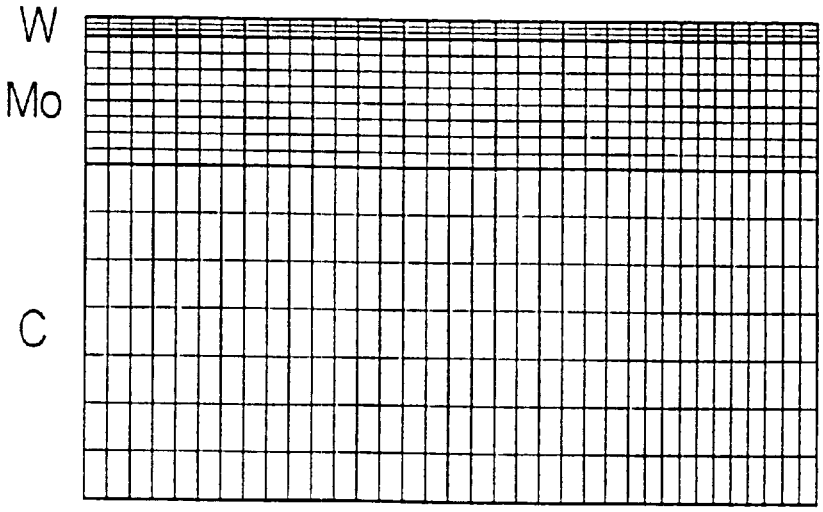
FIG. 18 shows the non-equidistant division of the cylinder region into discrete portions for taking, for example, inhomogeneities of the anode material into consideration, in accordance with the principles of the present invention.

FIG. 17 shows an equidistant discretization of the two-dimensional cylinder 20. An in equidistant discretization is shown in FIG. 18. In this case, the z-regions of the material layers and the radial regions inside and outside the inner focal ring radius are discretized differently. The critical advantage of the in equidistant compared to the equidistant discretization is the possibility of being able to implement calculations with a lower number of grid points. An adaptation of $\lambda$, $c_p$ and $\epsilon$ thereby ensues from point-in-time to point-in-time according to the average layer temperature or average z-plane temperature.

The method of alternating directions, the Crank-Nicholson method in each direction, is selected as calculating method for the finite difference calculation. All nine-linear effects (emission, temperature dependency of the material parameters, etc.) are linearized. Linear equation systems with tri-diagonal matrices thus derive. As a result of these tri-diagonal matrices, a drastic saving in calculating time derives, as a result whereof a calculation can ensue in real time.

For calculating the radiation exchange, the Stefan-Boltzmann radiation log $$p = \sigma\varepsilon(T^4 - T^4_{subhousing})$$

Figure 19:
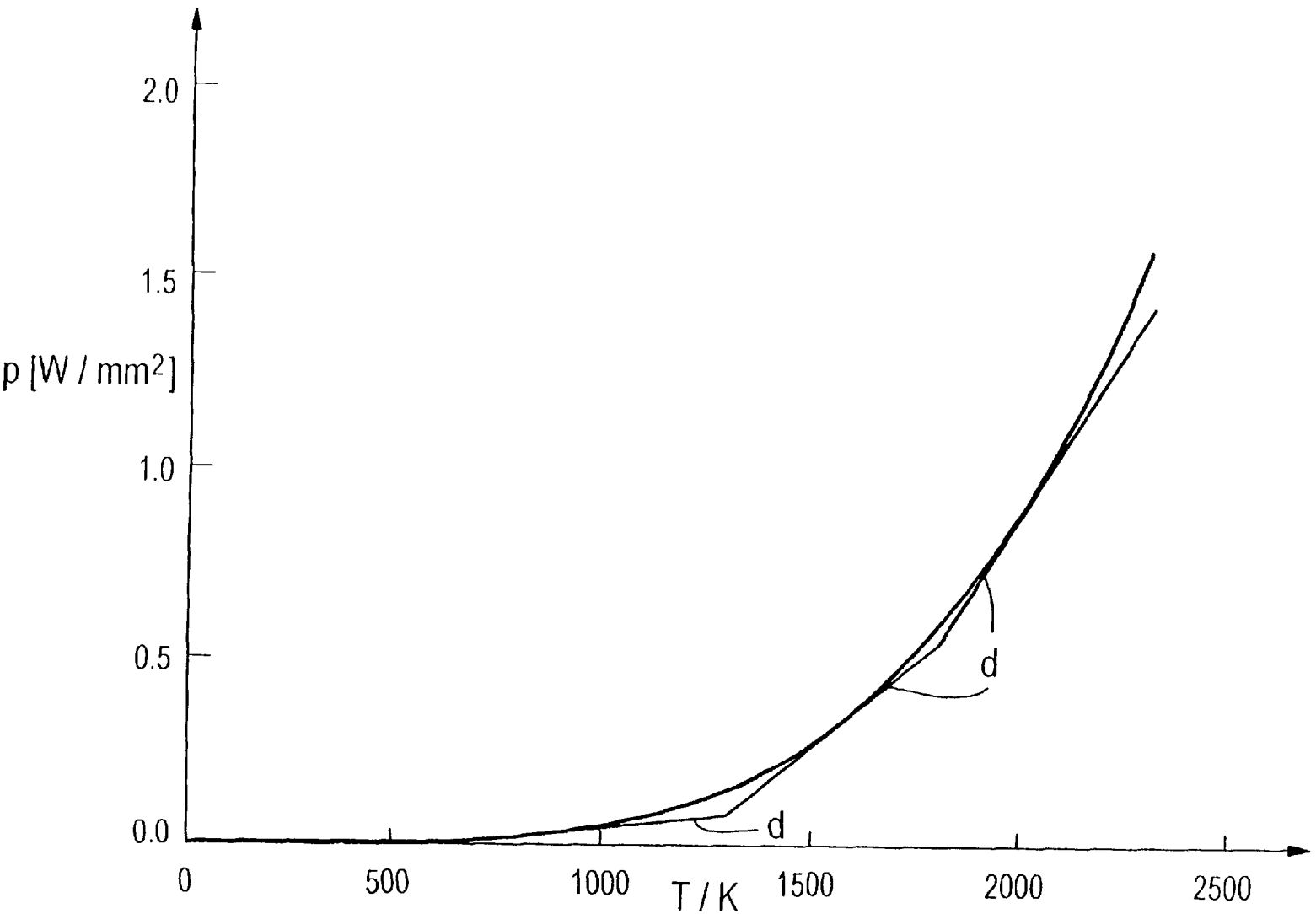
FIG. 19 illustrates possible ways to linearize the radiation curve according to the Stefan-Boltzmann law, with four linearization intervals.
Figure 20:
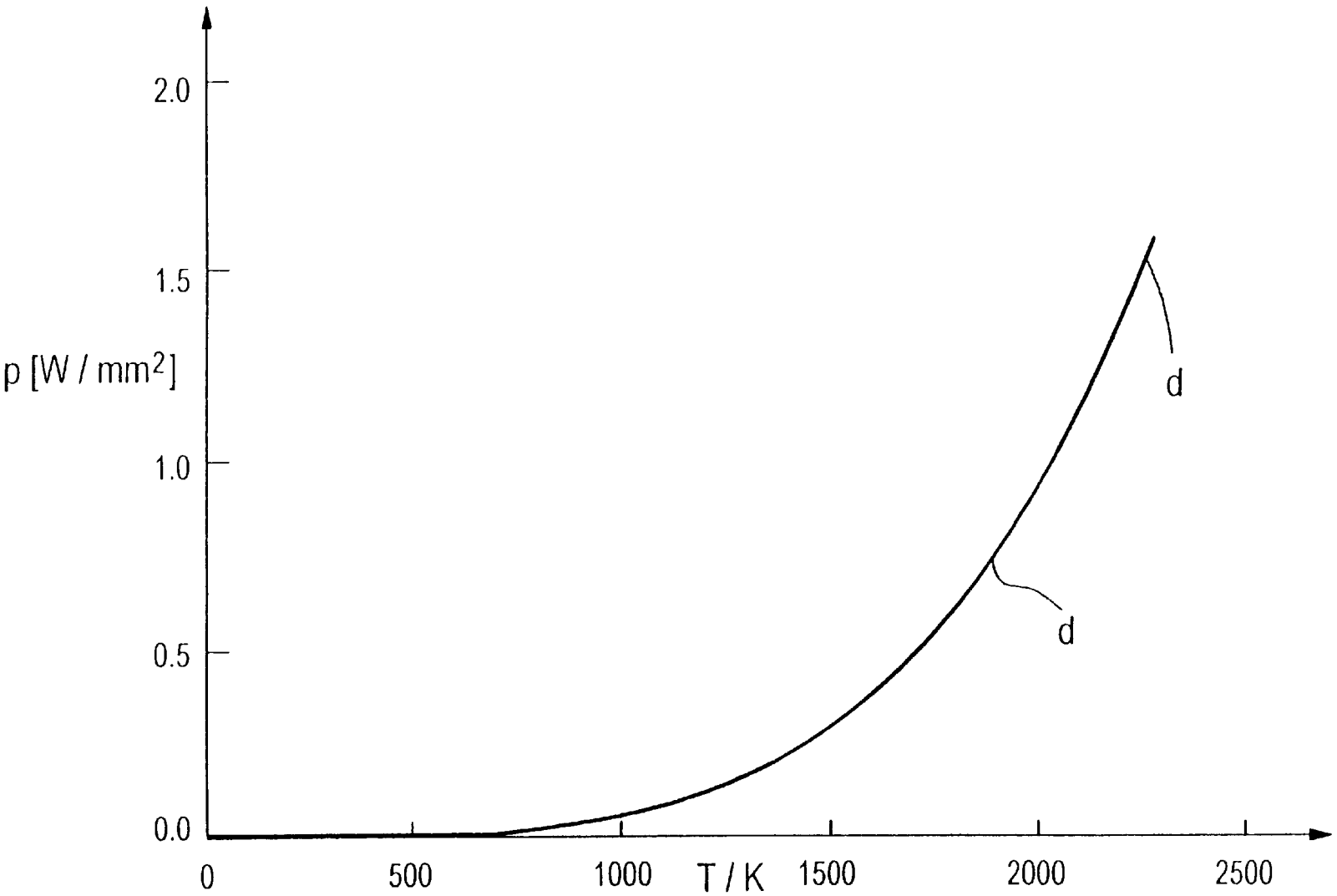
FIG. 20 illustrates possible ways to linearize the radiation curve according to the Stefan-Boltzmann law, with twenty linearization intervals.

$\sigma$ Stefan-Boltzmann constant $\varepsilon$ emissivity between anode and environment is linearized section-by-section in the form of temperature intervals (see FIGS. 19 and 20 ). The linearization interval in which the average surface temperature of a material layer falls is selected for the calculation. Given upward/downward transgression of the interval boundaries, calculation is carried out with a different tangent d that derives as a result of the linearization. A housing temperature $T_{subhousing}$=300 K thereby formed the basis.

The temperature dependencies shown in FIGS. 21 through 24 for the material parameters of thermal conductivity, specific heat capacity, emissivity as well as diffusion are taken in to consideration according to the above-defined temperature intervals (see FIGS. 19 and 20) and the average temperatures of the material layers (11, 12, 13).

FIGS. 5 through 14 show calculation results that derive from the inventive method in view of the short-term behavior of the temperature development of the anode. The parameters of the temperature development to be taken into consideration according to the invention were varied on and in the anode 1. All calculations were implemented with a power P of 20 kW, a back scatter coefficient $\eta$=0.372, a kinetic energy $E_{kin}$ of 120 keV, a load time of 106.1 $\mu$s and a focus size of 1.4×9.62 mm$^2$. Maximum temperatures $T_{max}$=511 K in FIG. 8 and of $T_{max}$=538.7 K in FIG. 12 were thereby assumed.

Figure 16:
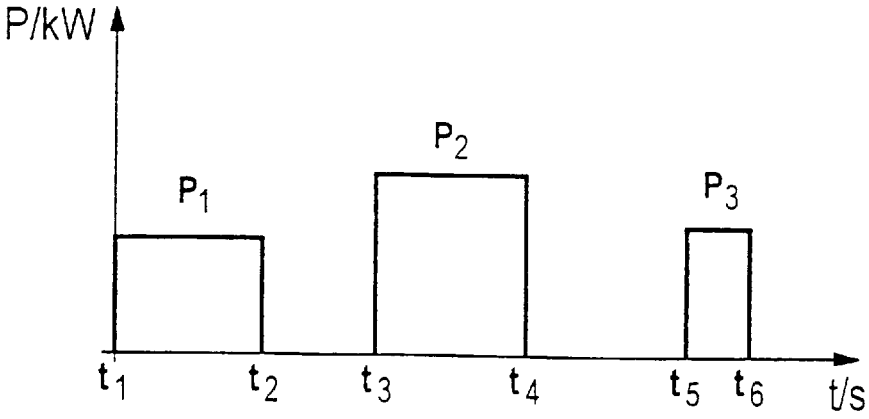
FIG. 16 shows the setting of the variable load and the pause intervals in scans having different beam powers, in the inventive apparatus.

FIG. 16 shows load and pause intervals with different beam powers as introduced in the inventive calculation.

FIGS. 25 through 28 show further calculation results according to the inventive method in view of the long-term behavior of the temperature distribution in and on the anode. These calculations were based on the three-layer cylinder having the aforementioned dimensions, a power P of 20 kW, a back scatter coefficient $\eta_{BR}$=0, 2, a kinetic energy $E_{kin}$ of 120 keV, a location $R_{BR\text{-}middle}$=42 mm, a focus size of 1.4×9.62 mm$^2$ and—for FIGS. 25 and 26, a grid size of $\Delta r=\Delta z$=0.5 mm and $\Delta t$=0.01 s , a grid size of $\Delta r$ (1.0, 0.8, 1.0) mm $\Delta z$=0.5, 1, 1.5) mm and $\Delta t$=0.05 s for FIG. 27, and a grid size of $\Delta r$ (1.0, 0.8, 1.0) mm, $\Delta z$=(0.5, 1,3) mm and $\Delta t$=0.05 s for FIG. 28.

The temporal temperature development at four different locations in the center of the focal ring given a fast scan sequence 15 1-s scans, 15 1-s pauses given an exposure time of t=29 s is shown in FIG. 27. The curves, from top to bottom, show the curve at the anode surface, at the boundary between tungsten and molybdenum at the boundary between molybdenum and graphite and at the anode bottom surface as depth coordinate (0, 1, 9, 30 mm).

Figure 26:
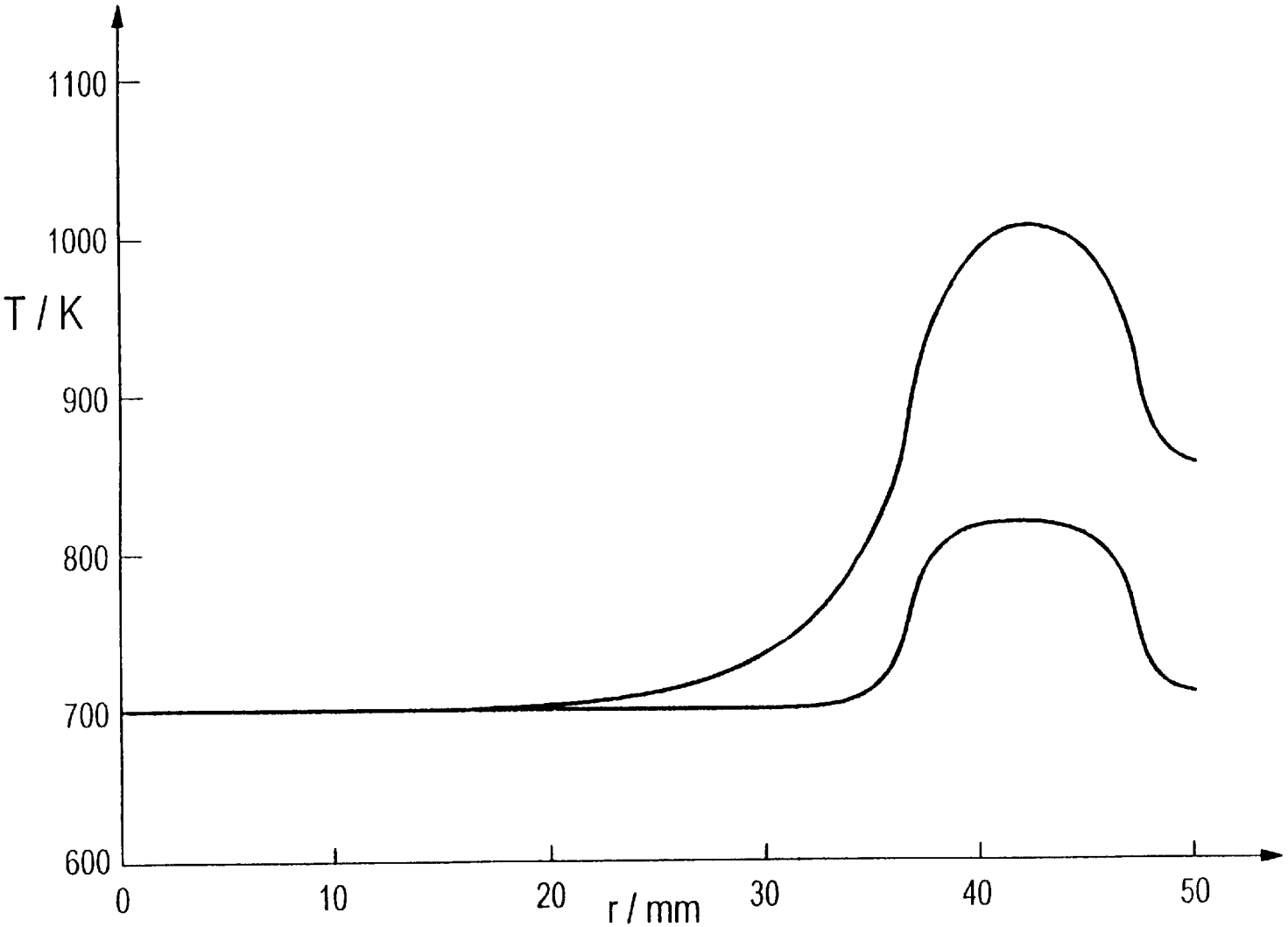
FIG. 26 shows the temperature development on the anode surface calculated according to the principles of the present invention as a function of the radius r proceeding from the center of the focal ring.
Figure 28:
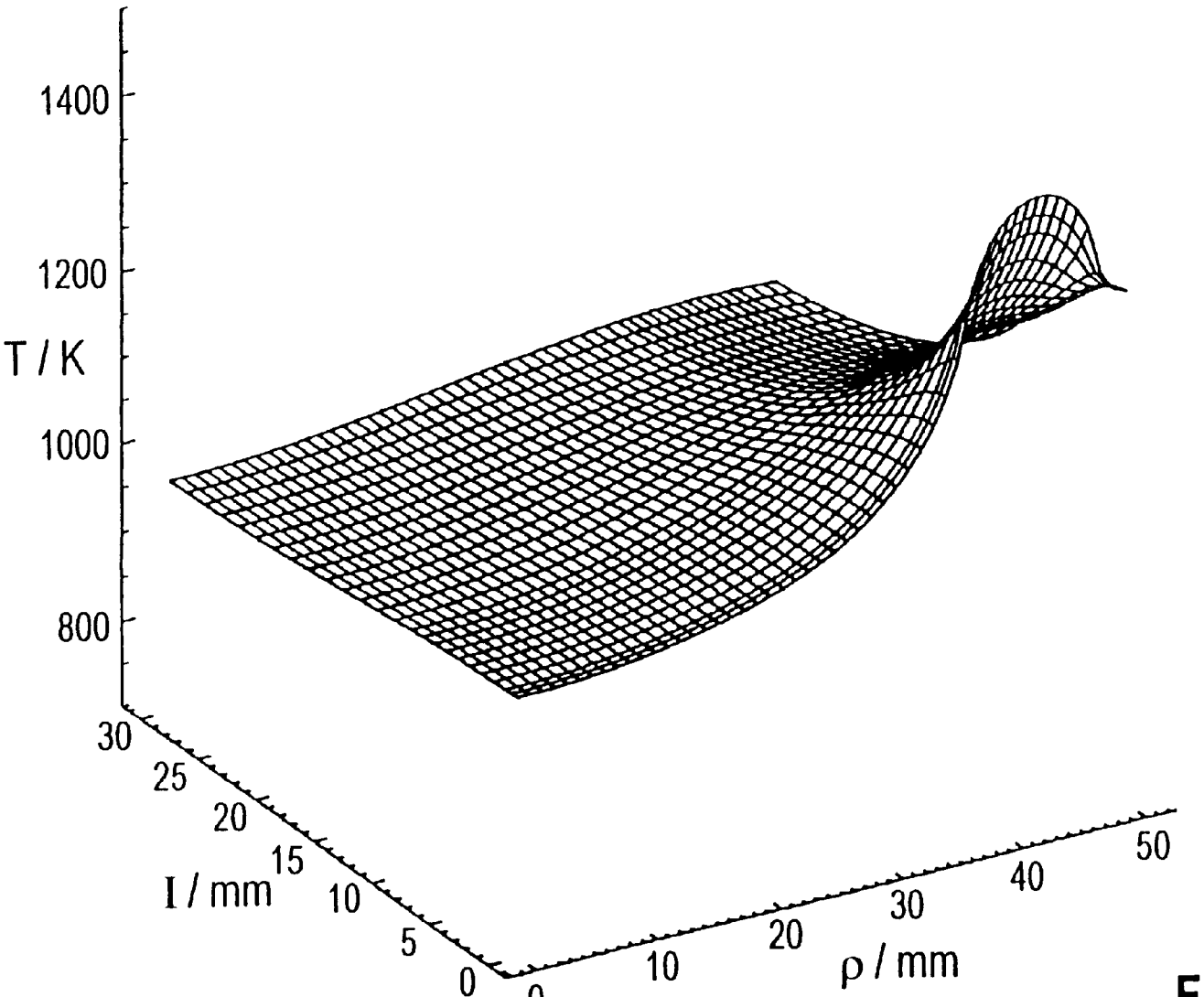
FIG. 28 shows the temperature development calculated in accordance with the invention on the basis of a three-layer cylinder model, wherein the temperature is shown dependent on the depth (z) and the radius (r) of the model cylinder of the anode.

The spatial 2D temperature distribution, the temperature distribution in the radial and depth direction, at the end of the fifteenth scan and the fast scan sequence (15 1-s scans, 15 1-s pauses) is likewise shown without boost in FIG. 28 as in the case of the curves according to FIGS. 26 and 27. The upper curve in 25 reproduces the temporal temperature development in the middle of the focal ring given continuous load and the lower curve reproduces this without boost of the focal ring temperature. The upper curve in FIG. 26 shows the radial temperature curve given an exposure time of 1 s and the lower shows this given an exposure time of 0.1 s.

In summary, thus, two different contributions to the load of an anode of an x-ray tube are taken into consideration in the invention, namely the short-term load by involving the critical physical effects into the calculation model, and the long-term load by considering the electron back scatter, the temperature-dependent, segmented linearization of the non-linear physical effects (emission from the surface according to a $T^4$ law and temperature dependency of the material parameters) in order to thus enable real-time calculations—on the basis of the combination of numerical methods (Crank-Nicholson method and ADI method (implicit method of alternating directions for the rz-directions) and of the explicit solution of linear, generalized, tri-diagonal equation systems. The exact involvement of the non-linear effects ensues in other models that, however, were involved in terms of calculating time (for example, finite element models).

Although modifications and changes may be suggested by those skilled in the art, it is the intention of the inventor to embody within the patent warranted hereon all changes and modifications as reasonably and properly come within the scope of his contribution to the art.

I claim:

1. A method for calculating a space-time temperature distribution in an anode of an X-ray tube on which electrons are incident, for determining a load of said X-ray tube, comprising the steps of:

calculating a short-term temperature boost in a surface layer in and around a focal spot of said electrons on said anode for a time span during and immediately after said electrons are incident on said focal spot according to the heat equation for a homogeneous heat conductor;

calculating a long-term temperature distribution in an overall volume of said anode dependent on heat propagation emanating from said focal spot and heat emission from said surface of the anode according to the heat equation for an inhomogeneous heat conductor, and temperature dependently linearizing any non-linear effects in sections of said anode;

adding respective results of said calculation of said short-term temperature boost and said calculation for said long-term temperature distribution to determine a calculated temperature distribution on and in said anode; and determining a load on said load dependent on said calculated temperature distribution.

2. A method as claimed in 1 comprising the additional step of displaying said load.

3. A method as claimed in claim 1 comprising the additional step of controlling said X-ray tube dependent on said load.

4. A method as claimed in claim 1 comprising calculating said short-term temperature boost dependent on at least one of:

backscatter of incident electrons as a multiplicative factor $(1-\eta)$;

three-dimensional heat flow by describing said surface layer as a thermally conductive, three-dimensional infinite half space; and energy loss of the incident electrons in a depth of said material of said anode.

5. A method as claimed in claim 1 comprising the additional step of producing a relative movement of said anode with respect to said electrons, and calculating said short-term temperature boost dependent on said relative motion by determining a topical variation of a heat source function.

6. A method as claimed in claim 1 comprising striking said anode with electrons in an electron beam having an inhomogeneous profile and calculating said short-term temperature boost by dividing an area of said focal spot into discrete surface elements.

7. A method as claimed in claim 1 comprising calculating said long-term temperature distribution dependent on at least one of:

backscattering of incident electrons as a multiplicative factor $(1-\eta)$;

three-dimensional heat flow by describing the volume of said anode as a cylinder composed of a material layer at a surface of said cylinder with further layers of other materials disposed below said surface layer;

radiation exchange between said surface of said anode and an environment of said anode; and temperature dependency on material parameters of material comprising said anode.

8. A load computer for calculating a temperature distribution of an anode in an X-ray tube, said anode having electrons incident thereon, for calculating a load of said X-ray tube, said computer being programmed for calculating a short-term temperature boost in a surface layer in and around a focal spot of said electrons on said anode for a time span during and immediately after said electrons are incident on said focal spot according to the heat equation for a homogeneous heat conductor, calculating a long-term temperature distribution in an overall volume of said anode dependent on heat propagation emanating from said focal spot and heat emission from said surface of the anode according to the heat equation for an inhomogeneous heat conductor, and temperature dependently linearizing any non-linear effects in sections of said anode, adding respective results of said calculation of said short-term temperature boost and said calculation for said long-term temperature distribution to determine a calculated temperature distribution on and in said anode, and determining a load on said load dependent on said calculated temperature distribution.

9. A load computer as claimed in claim 8 wherein said load computer displays said load.

10. A load computer as claimed in claim 8, wherein said load computer controls said X-ray tube dependent on said load.

11. An X-ray apparatus comprising:

an X-ray tube having a rotating anode and a cathode which emits electrons which are incident on said rotating anode, said X-ray tube having a load associated therewith; and a load computer for calculating a temperature distribution of said rotating anode, said load computer being programmed for calculating a short-term temperature boost in a surface layer in and around a focal spot of said electrons on said anode for a time span during and immediately after said electrons are incident on said focal spot according to the heat equation for a homogeneous heat conductor, calculating a long-term temperature distribution in an overall volume of said anode dependent on heat propagation emanating from said focal spot and heat emission from said surface of the anode according to the heat equation for an inhomogeneous heat conductor, and temperature dependently linearizing any non-linear effects in sections of said anode, adding respective results of said calculation of said short-term temperature boost and said calculation for said long-term temperature distribution to determine a calculated temperature distribution on and in said anode, and determining a load on said load dependent on said calculated temperature distribution.

12. An X-ray apparatus as claimed in claim 11 wherein said rotating anode is composed of a surface layer of tungsten and a plurality of further layers of other materials disposed below said surface layer.

13. An X-ray apparatus as claimed in claim 11 wherein said cathode emits said electrons in a beam having a beam profile with inhomogeneities.

* * * * *